US007186009B2

(12) United States Patent
Yamamura et al.

(10) Patent No.: US 7,186,009 B2
(45) Date of Patent: Mar. 6, 2007

(54) VEHICLE HEADLAMP

(75) Inventors: Satoshi Yamamura, Shizuoka (JP); Hidetada Tanaka, Shizuoka (JP); Michio Tsukamoto, Shizuoka (JP); Noriko Okada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 91 days.

(21) Appl. No.: 11/001,119

(22) Filed: Dec. 2, 2004

(65) Prior Publication Data

US 2005/0117363 A1 Jun. 2, 2005

(30) Foreign Application Priority Data

Dec. 2, 2003 (JP) ..... P.2003-403593
Oct. 22, 2004 (JP) ..... P.2004-308540

(51) Int. Cl.
*F21V 7/00* (2006.01)

(52) U.S. Cl. ..... 362/517; 362/297; 362/346; 362/518

(58) Field of Classification Search ..... 362/509, 362/514, 515, 516–518, 538–539, 296–297, 362/298, 341, 347, 350, 346, 507
See application file for complete search history.

(56) References Cited

U.S. PATENT DOCUMENTS 5,055,981 A * 10/1991 Nino ..... 362/539
6,953,272 B2 * 10/2005 Hayakawa et al. ..... 362/517

FOREIGN PATENT DOCUMENTS

JP 2-47704 U 4/1990
JP 2001-229715 A 8/2001

* cited by examiner

*Primary Examiner*—Thomas M. Sember
*Assistant Examiner*—Jason Moon Han
(74) *Attorney, Agent, or Firm*—Sughrue Mion, PLLC

(57) ABSTRACT

A light source bulb is fixedly inserted into a lateral direction to the optical axis Ax at a position below an optical axis Ax. Accordingly, a region lateral to the optical axis Ax on a reflection surface of the reflector can be effectively utilized for light distribution control. Furthermore, a first additional reflector having a reflection surface of substantially-spheroidal shape whose first focal point is at a position coincident with the light source is disposed at a position above the optical axis Ax. A second additional reflector 36 having a reflection surface of a substantially-parabolic vertical cross-sectional profile whose focal point is coincident with a second focal point of the first additional reflector is disposed at a position below the optical axis. As a result, light from the light source is illuminated forward without passing through a projection lens.

20 Claims, 20 Drawing Sheets

VEHICLE HEADLAMP

This application claims foreign priority based on Japanese patent application Nos. 2003-403593 and 2004-308540, filed on Dec. 2, 2003, and Oct. 22, 2004 respectively, the contents of which are incorporated herein by reference in their entirety.

BACKGROUND OF THE INVENTION

1. Technical Field

The present invention relates to a projector-type vehicle headlamp.

2. Related Art

In the related art, a vehicle headlamp is generally configured such that a projection lens is disposed on an optical axis extending in a longitudinal direction of a vehicle. Also, a light source is disposed to the rear of a rear focal point of the projection lens. As a result, light from the light source is reflected close to the optical axis by means of a reflector.

In relation to such a projector-type vehicle headlamp, Japanese publications JP-A-2-47704 and JP-A-2001-229715 disclose a lamp configuration of a lateral-insertion type, wherein a light source includes a light-emitting section of a light source bulb that is fixedly inserted into a reflector in a lateral direction in relation to the optical axis.

When such a lamp configuration is of the related art lateral-insertion type, the lamp can be reduced in longitudinal length to be miniaturized.

However, in the vehicle headlamp disclosed in the above-described publications, the light source bulb is fixedly inserted into the reflector within a horizontal plane that includes the optical axis. Accordingly, at least the following related art problem arises.

In a related art projector-type vehicle lamp, a region lateral to the optical axis on a reflection surface of a reflector is suitable for forming a diffusion region of a light distribution pattern. However, when the light source bulb is fixedly inserted into the reflector within a horizontal plane that includes the optical axis, a hole for insertion and fixation of the light source bulb is formed on the region lateral to the optical axis on the reflection surface.

Accordingly, there is a related art problem in that the region lateral to the optical axis cannot be effectively used for light distribution control. Further, ensuring sufficient brightness of the diffusion region of the light distribution pattern becomes difficult.

SUMMARY OF THE INVENTION

The present invention has been conceived in view of the foregoing. An object of the present invention includes providing a projector-type vehicle headlamp capable of ensuring sufficient brightness of a diffusion region of a light distribution pattern, even when a lamp configuration is of a lateral insertion type.

However, the present invention need not achieve this object or any disclosed object, and other objects may be achieved. Alternatively, no objects may be achieved without affecting the scope of the invention.

The present invention aims at achieving the object by making contrivance to a position at which the light source bulb is fixedly inserted to the reflector and by adopting a configuration in which predetermined additional reflectors are included.

More specifically, a vehicle headlamp of the present invention is characterized by being configured as follows.

A vehicle headlamp has a projection lens disposed on an optical axis extending in a longitudinal direction of a vehicle, a light source disposed to the rear of a rear focal point of the projection lens, and a reflector for reflecting light from the light source forward and close to the optical axis.

The light source is constituted of a light-emitting section of a light source bulb which is fixedly inserted into the reflector in a lateral direction to the optical axis at a position below the optical axis.

In the light source, a first additional reflector with a substantially-spheroidal reflection surface, the reflection surface having a first focal point at the position of the light source is disposed at a position upwardly spaced from the optical axis, and a second additional reflector is disposed at a position downwardly spaced from the optical axis. The second additional reflector forwardly diffuses and reflects light from the light source reflected on the first additional reflector in the horizontal direction without passing through the projection lens.

A light distribution pattern formed by means of the vehicle headlamp according to the invention may be a low-beam light distribution pattern, a high-beam light distribution pattern, or another light distribution pattern.

No particular limitation is imposed on the type of the light source bulb. For example, a discharge bulb, a halogen bulb, or the like can be employed.

The light source bulb is fixedly inserted into the reflector at "a position downwardly spaced from the optical axis." However, no particular limitations are imposed on the amount of downward offset, from the optical axis, of a position where the light source bulb is fixedly inserted. At the time of insertion of the reflector, from a viewpoint of prevention of the light source bulb from shielding light from the light source bulb reflected in the vicinity of the optical axis on the reflection surface of the reflector, the downward displacement is preferably set to about 10 mm or more, more preferably to about 15 mm or more.

If the second additional reflector is constituted such that the second additional reflector forwardly diffuses and reflects the light in the horizontal direction without passing through the projection lens, a specific shape of the reflection surface or the arrangement thereof is not limited.

The reflector, the first additional reflector, and the second additional reflector may be configured integrally, or may be configured separately.

The present invention has various advantages. For example, but not by way of limitation, as shown in the above configuration, the vehicle headlamp according to the invention is configured as a vehicle headlamp of a projector type. However, the light source is fixedly inserted into the reflector in a direction lateral to the optical axis extending in the longitudinal direction of the vehicle. Accordingly, the lamp can be miniaturized by being reduced in longitudinal length.

Accordingly, because the light source bulb is fixedly inserted at a position below the optical axis, a region lateral to the optical axis on the reflection surface of the reflector can be effectively utilized for light distribution control. By means of forming a diffusion region of a light distribution pattern with use of the reflected light from the region lateral to the optical axis, sufficient brightness can be ensured for the diffusion region.

Further, the vehicle headlamp according to the present invention is configured such that the first and second additional reflectors allow light from the light source to illuminate forward without passing through a projection lens. Therefore, additional light distribution patterns formed by such illumination are superposed on a basic light distribution pattern formed by the light, which has been reflected on a reflector and passed through the projection lens. Consequently, sufficient brightness can be ensured for the entire light distribution pattern formed by illumination from the vehicle headlamp.

The first additional reflector has a substantially-spheroidal reflection surface whose first focal point is situated at the position of the light source. The second additional reflector has a reflection surface of a substantially-parabolic vertical cross-sectional profile. The reflection surface has as its focal point a second focal point of the first additional reflector. Therefore, the first and the second additional reflectors are capable of forming additional light distribution patterns as horizontally elongated light distribution patterns, whereby the diffusion region can be brightened further.

In addition, because the first additional reflector is disposed above the optical axis, a sufficient distance can be ensured from the light source. Also, because the second additional reflector is disposed below the optical axis, a sufficient distance can be ensured from the first additional reflector. As a result, curvature of the reflection surface of the first additional reflector can be reduced to a comparatively small value, whereby reflection light can be controlled with good accuracy by means of the first and second additional reflectors.

As described above, a projector-type vehicle headlamp according to the present invention is capable of ensuring sufficient brightness of a diffusion region of a distribution pattern even when a lamp configuration is of a lateral insertion type.

According to the above configuration, even when the reflection surface of the second additional reflector is formed into a substantially parabolic vertical cross-sectional shape, and the reflection surface has as a focal point the second focal point of the first additional reflector, the vertical width of additional light distribution pattern formed by the first and second additional reflectors can be limited to the minimum.

In the above case, when the reflection surface of the second additional reflector is formed into a substantially-parabolic, cylindrical-curved surface, sufficient lateral diffusion angles can be ensured for the additional light distribution patterns. Here, the term "substantially-parabolic, cylindrical-curved surface" means a cylindrically-curved surface whose cross-sectional profile pattern is constituted of a parabola or a curve substantially approximating the parabola.

In relation to the above, when a focal line of the substantially-parabolic, cylindrically-curved surface is constituted of a line connecting first and second focal points of the first additional reflector, not only light reflected on the first additional reflector and incident in the second additional reflector, but also light directly incident in the second additional reflector from the light source can be reflected by the second additional reflector, as substantially parallel light having little diffusion in a vertical direction. Accordingly, brightness of the additional light distribution patterns can be further increased.

When the first and second focal points are positioned at a single height as described above, the additional light distribution patterns can be formed as light distribution patterns that accurately extend horizontally.

Furthermore, as described above, in the case in which the reflection surface of the second additional reflector is formed into the substantially parabolic vertical cross-sectional shape, which has as a focal point the second focal point of the first additional reflector, when the first focal point of the first additional reflector is positioned at a point close to the inner end of the line segment light source in a vehicle width direction and the second additional reflector is disposed toward the outside of the vehicle width direction with respect to a front direction of the optical axis direction in addition to configuring the light-emitting segment of the light source bulb with the line segment light source extending along the central axis of the bulb, the following operations and effects can be obtained.

In other words, by positioning the first focal point of the first additional reflector at the point close to the inner end of the line segment light source extending along the central axis of the bulb in the vehicle width direction, the light source image formed on a focal plane including the second focal point by the light reflected from the first additional reflector can become the image that the outer end of the segment light source in the vehicle width direction is positioned at the second focal point. In addition, by using the light source image as the similar light source and reflecting the light from the similar light source forward by the second additional reflector disposed toward the outside of the vehicle width direction with respect to the front direction of the optical direction, the light distribution patterns formed by the light reflected from the second additional reflector become the light distribution patterns that the upper end circumferences of the similar light source images (that is, images of the similar light source) are lined up. At this time, since the reflection surface of the second additional reflector has the substantially parabolic vertical cross-sectional shape, and has as a focal point the second focal point of the first additional reflector, the similar light source image formed by the light reflected from the second additional reflector becomes smaller and brighter gradually according to the variation of the reflection position in the reflection surface from the upper end circumference of the reflected surface to the lower end circumference of the reflected surface. In addition, the upper end circumferences of a plurality of the similar light source images having different sizes and brightnesses are lined up to form the light distribution patterns, so that it is possible to improve the long distance visibility of the road surface ahead of the vehicle outside the vehicle width direction and to irradiate the light onto the road surface ahead of the vehicle uniformly.

On the other hand, in the above-mentioned configuration, when the reflection surface of the second additional reflector is formed into the substantially parabolic vertical cross-sectional shape, having as a first focal point the second focal point of the first additional reflector and having as a second focal point a point positioned at a position having the substantially same height as the lower end circumference of the reflection surface ahead of a predetermined distance with respect to the first focal point, the following operations and effects can be obtained.

That is, the light reflected from the first additional reflector incident on a region close to the lower end circumference in the reflection surface of the second additional reflector is reflected in a direction substantially parallel to the optical axis with respect to the vertical direction and is reflected downward as the light approaches the upper end circumference. At this time, the similar light source image formed by the light reflected from the second additional reflector becomes gradually smaller and brighter according to the variation of the reflection position in the reflection surface from the upper end circumference to the lower and circumference. In addition, the small and bright image of the plurality of similar light source images having different sizes and brightnesses is positioned at the upper end circumference to form the light distribution patterns, so that it is possible to improve the long distance visibility of the road surface ahead of the vehicle outside the vehicle width direction and to irradiate the light onto the road surface ahead of the vehicle uniformly from the short distance region to the long distance region.

At this time, the second focal point of the second additional reflector is positioned at the position ahead of the predetermined distance of the first focal point, but the specific distance is not limited thereto. When the distance is set to be long, it is possible to increase the vertical width of the light distribution pattern. On the other hand, when the distance is set to be short, it is possible to increase the vertical width of the light distribution pattern.

In the above-mentioned configuration, the second additional reflector is disposed to be offset in the left or right direction with respect to the optical axis at a position close to the projection lens between the light source and the projection lens, the third additional reflector that forward reflects the light from the light source is disposed under the light source, and the reflection surface of the third additional reflector is constituted such that the reflection surface reflects the light from the light source as the substantially parallel light with respect to the vertical direction and reflects the light from the light source toward the region close to the optical axis with respect to the horizontal direction. In this case, the following operations and effects can be obtained.

Specifically, when the second additional reflector is disposed at a position close to the projection lens between the light source and the projection lens, the light reflected from the second additional reflector can be forward irradiated without being shielded by the other lamp forming members.

When such a configuration is adopted, light directly incident in the second additional reflector cannot be obtained. However, light from the light source can be reflected forward by use of the third additional reflector. Accordingly, sufficient brightness of the additional light distribution pattern can be ensured. In relation to this, the reflection surface of the third additional reflector is configured such that light from the light source is reflected as substantially parallel light in relation to the vertical direction and is reflected closer to the optical axis in relation to the horizontal direction.

Accordingly, light reflected by the third additional reflector can be illuminated forward without being unintentionally shielded by the second additional reflector disposed offset to the right or to the left with respect to the optical axis and other component members of the lamp, whereby a horizontally elongated additional light distribution pattern can be obtained.

In the above configuration, when a shade for shielding a portion of reflection light from the reflector is disposed in the vicinity of a rear focal point of the projection lens in such a manner that an upper edge of the shade is located in the vicinity of the optical axis, a low-beam light distribution pattern having cutoff lines on its upper end edge can be formed. However, when such a configuration is employed, some of luminous flux is lost due to the presence of the shade. Therefore, effective utilization of the remaining luminous flux by means of adopting the configuration of the invention is particularly effective for ensuring sufficient brightness of a low-beam light distribution pattern.

Meanwhile, even when the shade is disposed as described above, the first additional reflector is disposed at a position above the optical axis, and the second additional reflector is disposed at a position below the optical axis. Accordingly, reflection light can be easily controlled by means of the first and second additional reflectors without being disturbed by presence of the shade.

Additionally, a vehicle headlamp having a lamp body with a chamber and a cover is provided, comprising a lamp unit with an optical axis and including a light source positioned below the optical axis. Also, a plurality of reflectors are provided that reflect light generated by the light source, including a first reflector that reflects light from the light source forward and substantially close to the optical axis, wherein the first reflector is elliptical, a second reflector positioned substantially above the optical axis and between the light source and a projection lens, the second reflector reflecting light generated by the light source to one of a first focal point and a second focal point positioned at a substantially same height, and a third reflector positioned substantially below the optical axis and between the light source and the projection lens, wherein the third reflector reflects light generated by the light source to form a first output pattern, and reflects light reflect by the second reflector to form a second output pattern.

DETAILED DESCRIPTION OF THE INVENTION

Embodiments of the present invention will be described hereinbelow by reference to the drawings. Unless otherwise specifically defined in the specification, terms have their ordinary meaning as would be understood by those of ordinary skill in the art.

The expression "reflection surface of a substantially-parabolic vertical cross-sectional profile" means a reflection surface formed from a curved surface which is configured such that perpendicular cross-sectional profile thereof is a parabola or approximates a parabolic curve. No particular limitation is imposed on the horizontal cross-sectional profile. As an example of such an approximate parabolic curve, a curve may be employed in which a parabola for illuminating reflected light farther and a deformed parabola deformed to a certain amount to illuminate reflected light slightly downward are connected.

Figure 1:
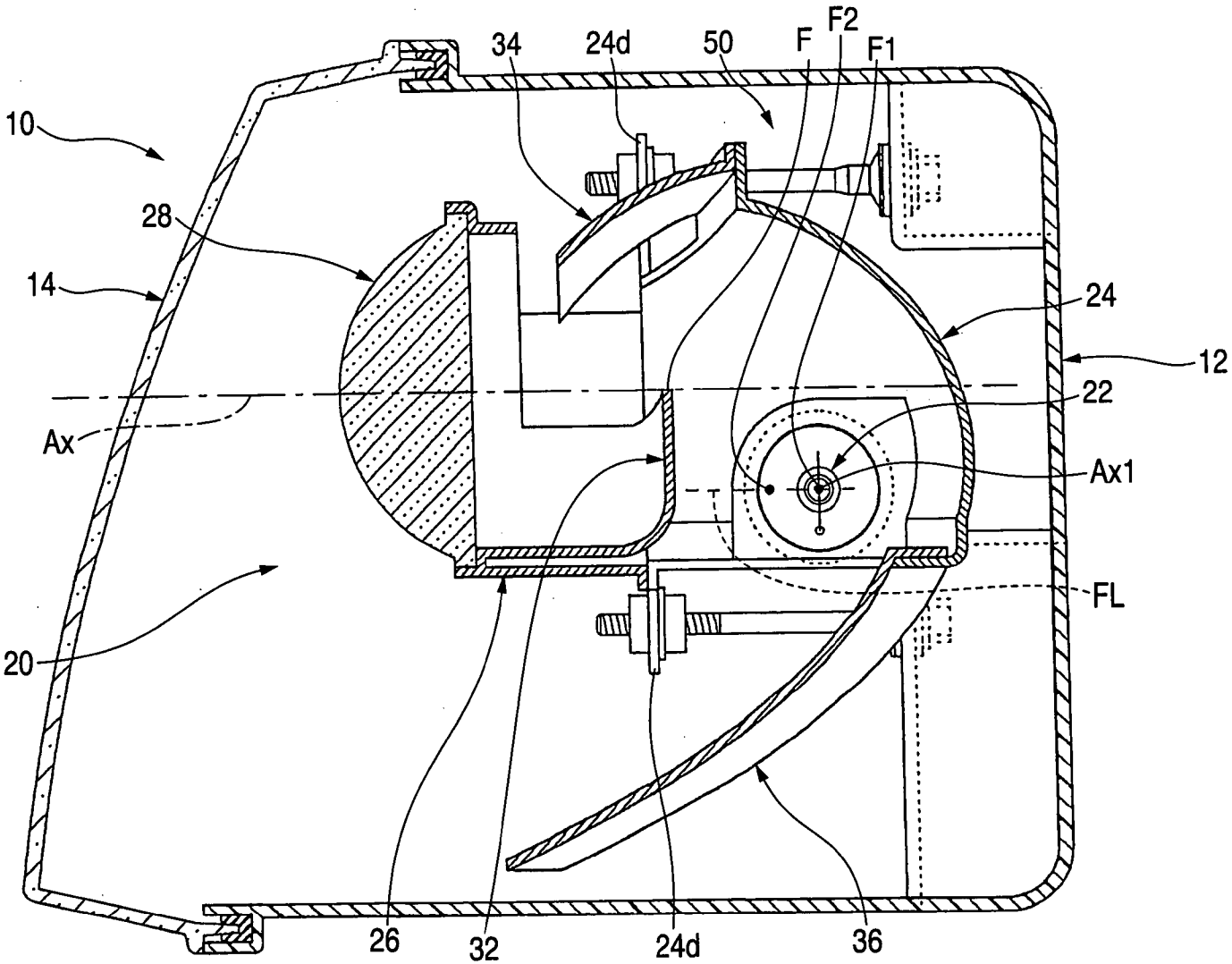
FIG. 1 is a side cross-sectional view showing a vehicle headlamp according to a first exemplary, non-limiting embodiment of the present invention.

A first exemplary, non-limiting embodiment of the present invention will be described below. FIG. 1 is a side cross-sectional view showing a vehicle headlamp according to the first exemplary, non-limiting embodiment. A vehicle headlamp 10 disposed at a right front end of a vehicle is configured as follows. In a lamp chamber constituted of a lamp body 12 and an unfrosted translucent cover 14 disposed at a front end opening of the lamp body 12, a lamp unit 20 is housed so as to allow tilting in a vertical direction and in a lateral direction by way of an aiming mechanism 50. The lamp unit 20 has an optical axis Ax extending in a longitudinal direction of the vehicle.

The lamp unit 20 is configured such that upon completion of aiming control by means of the aiming mechanism 50, the optical axis Ax extends in a direction oriented about 0.5 to 0.6° downward with respect to the longitudinal direction of the vehicle.

Figure 2:
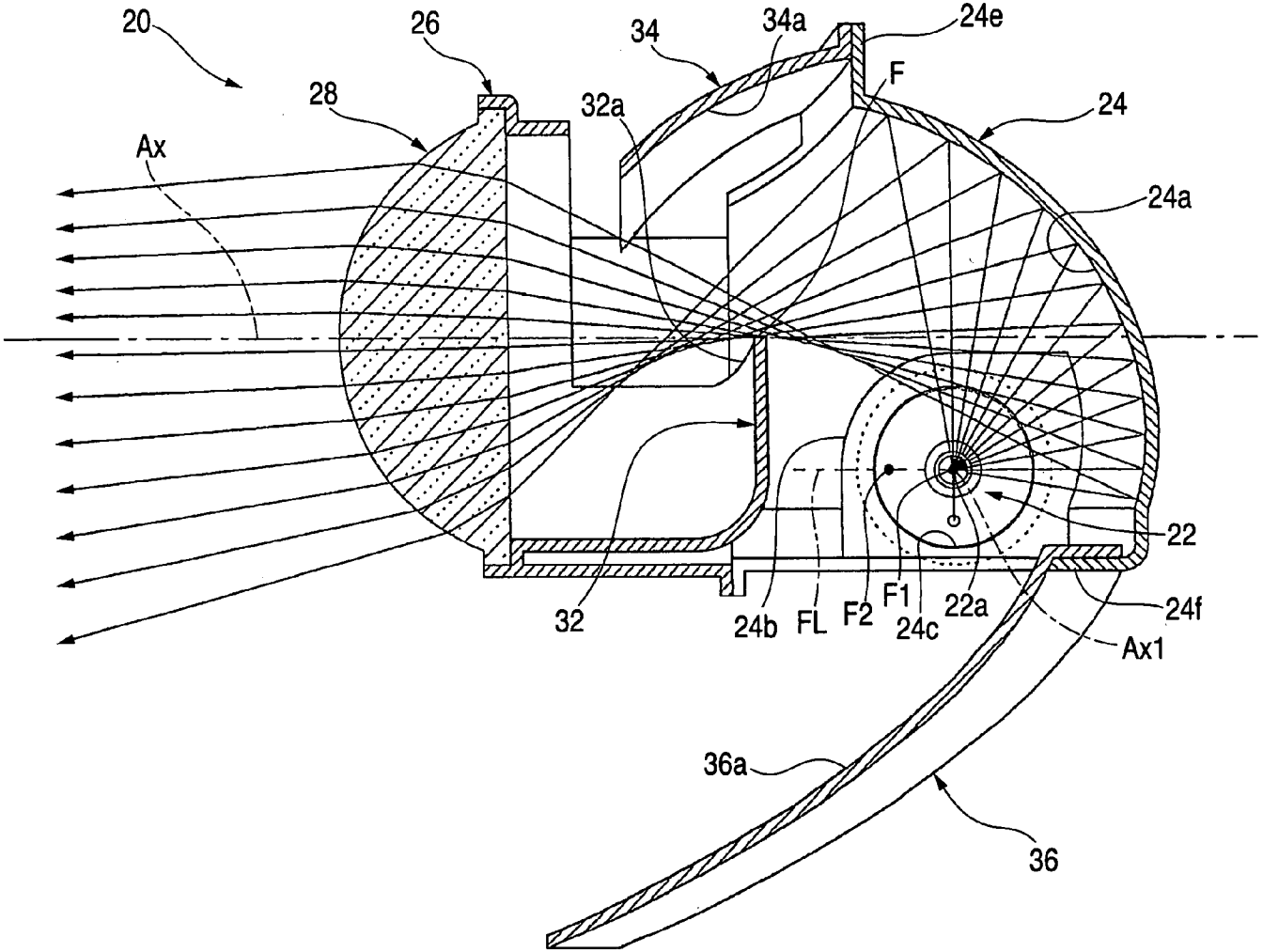
FIG. 2 is a side cross-sectional view showing a lamp unit of the vehicle headlamp as a single article and indicates optical paths of light reflected on a reflector, according to the first exemplary, non-limiting embodiment of the present invention.
Figure 3:
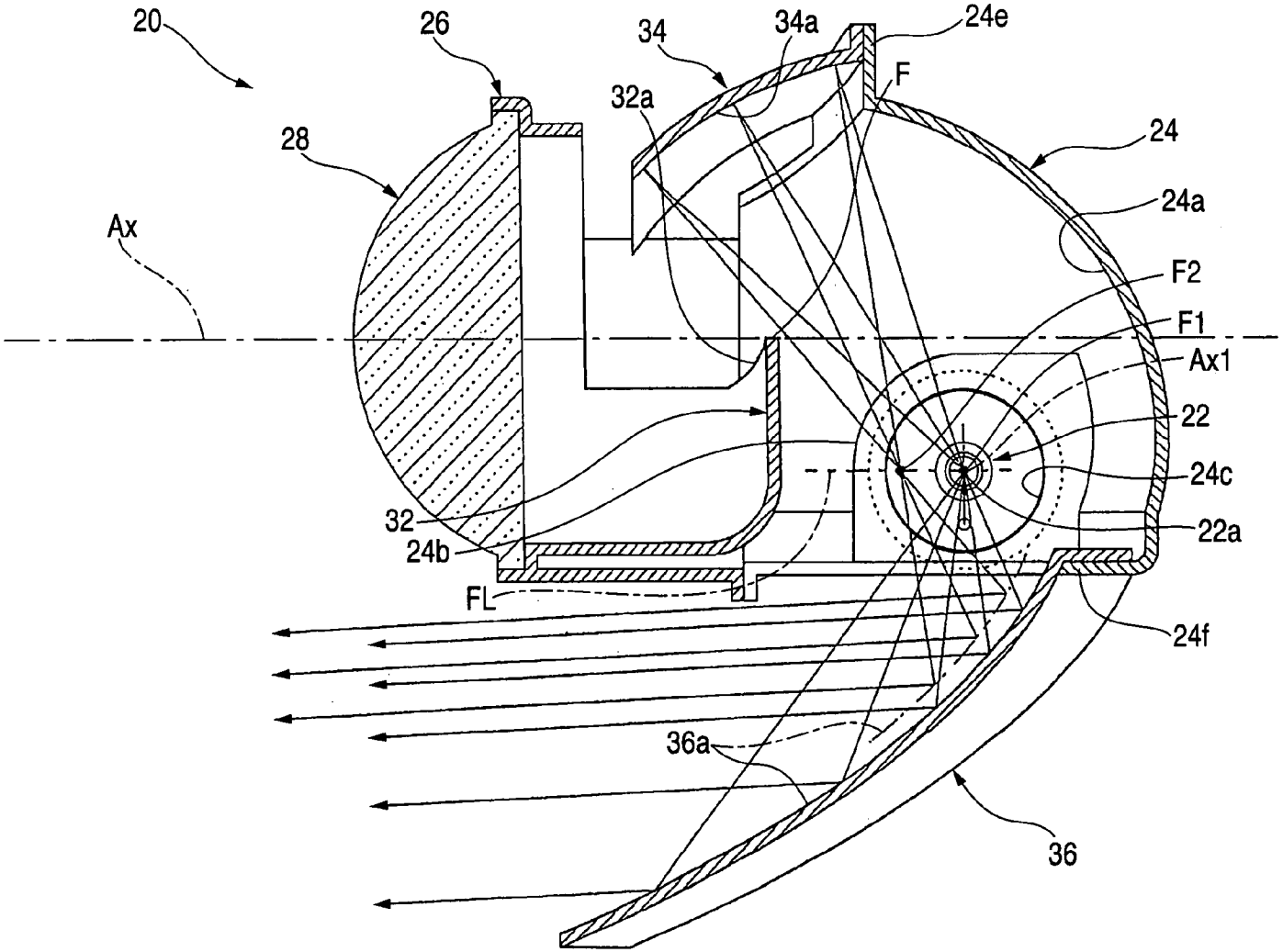
FIG. 3 is a side cross-sectional view showing the lamp unit as a single article and indicating optical paths of light reflected on first and second additional reflectors, according to the first exemplary, non-limiting embodiment of the present invention.
Figure 4:
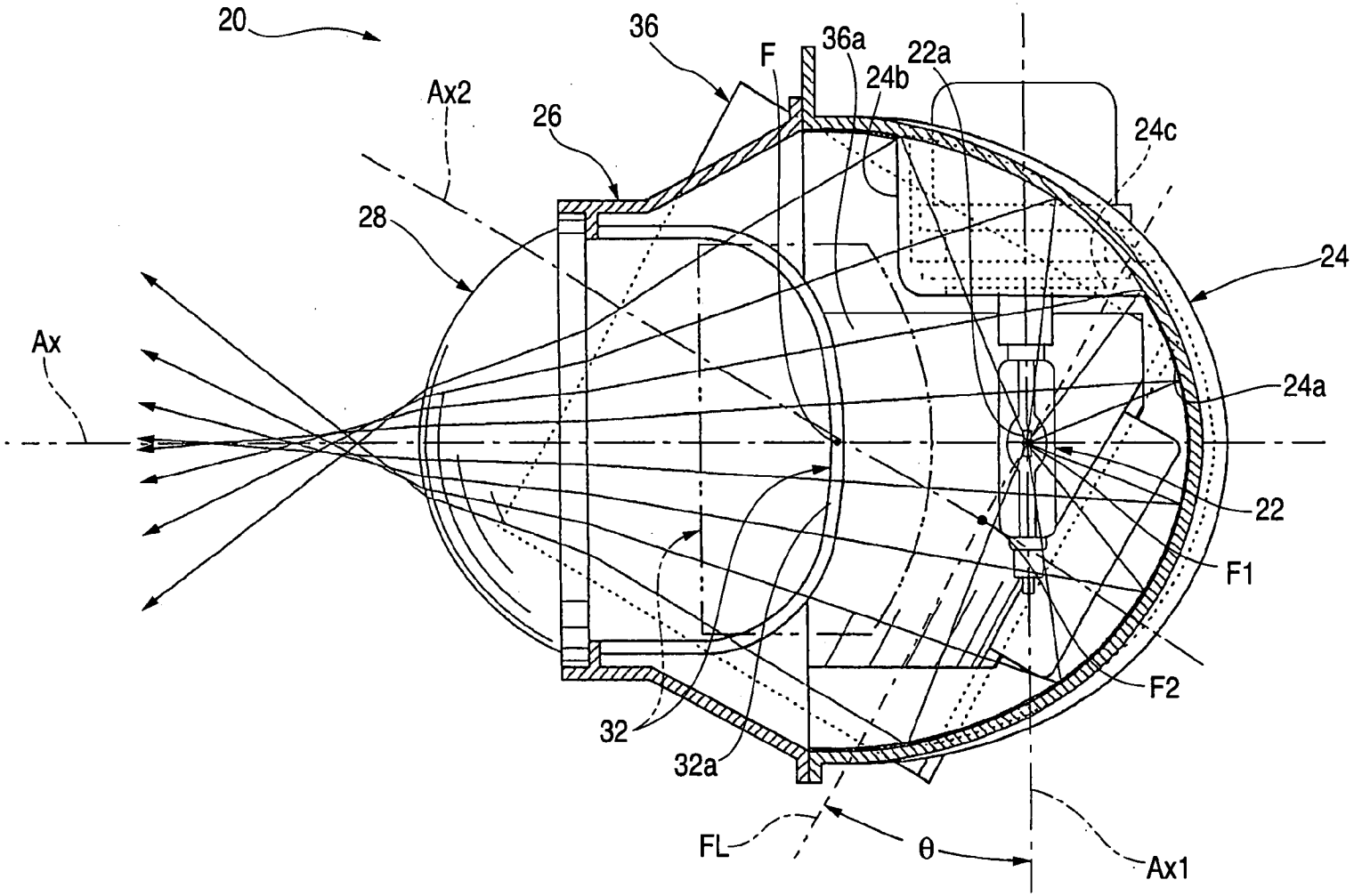
FIG. 4 is a top cross-sectional view showing the lamp unit as a single article and indicating optical paths of light reflected on the reflector, according to the first exemplary, non-limiting embodiment of the present invention.
Figure 5:
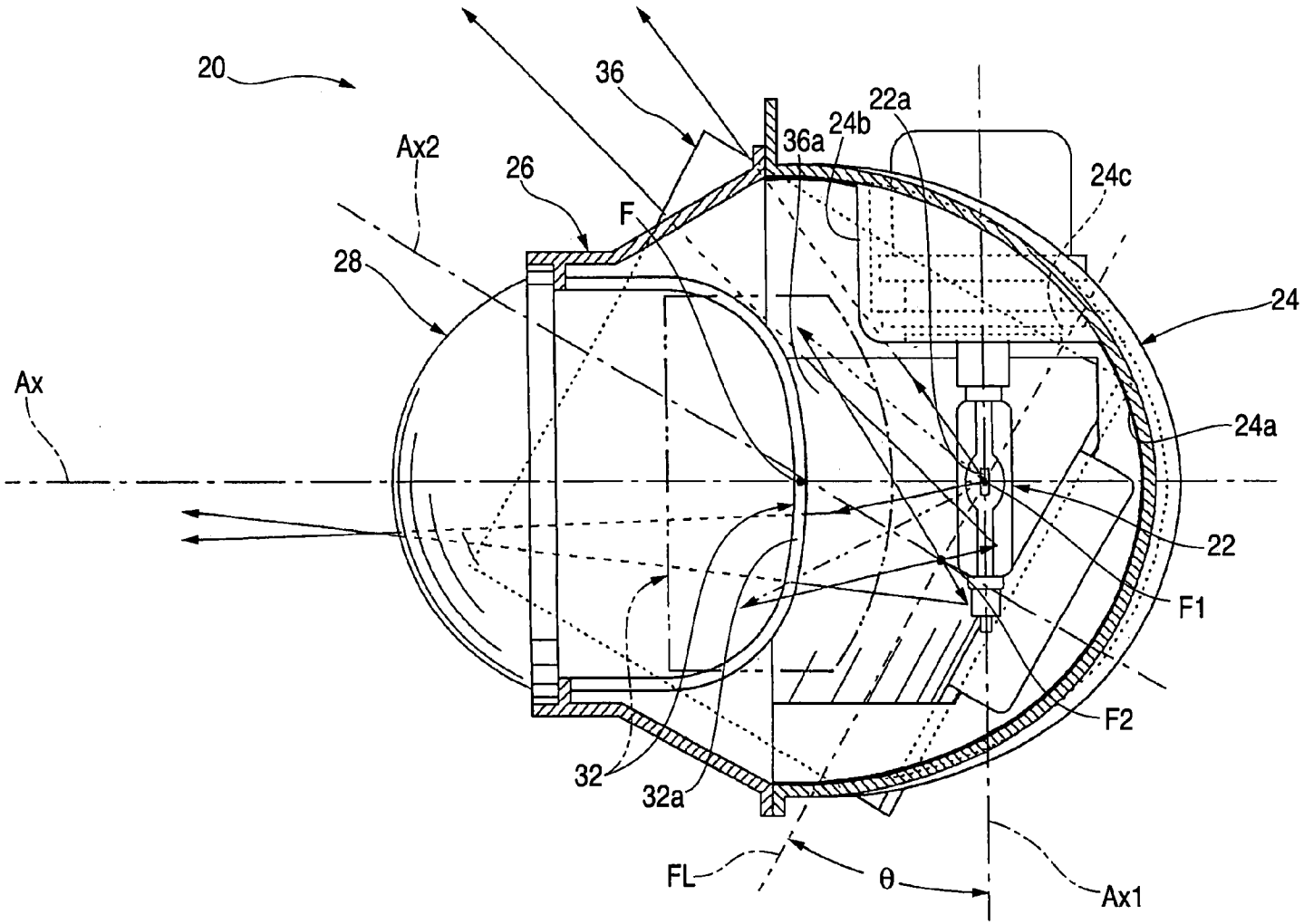
FIG. 5 is a top cross-sectional view showing the lamp unit as a single article and indicating optical paths of light reflected on the first and second additional reflectors, according to the first exemplary, non-limiting embodiment of the present invention.
Figure 6:
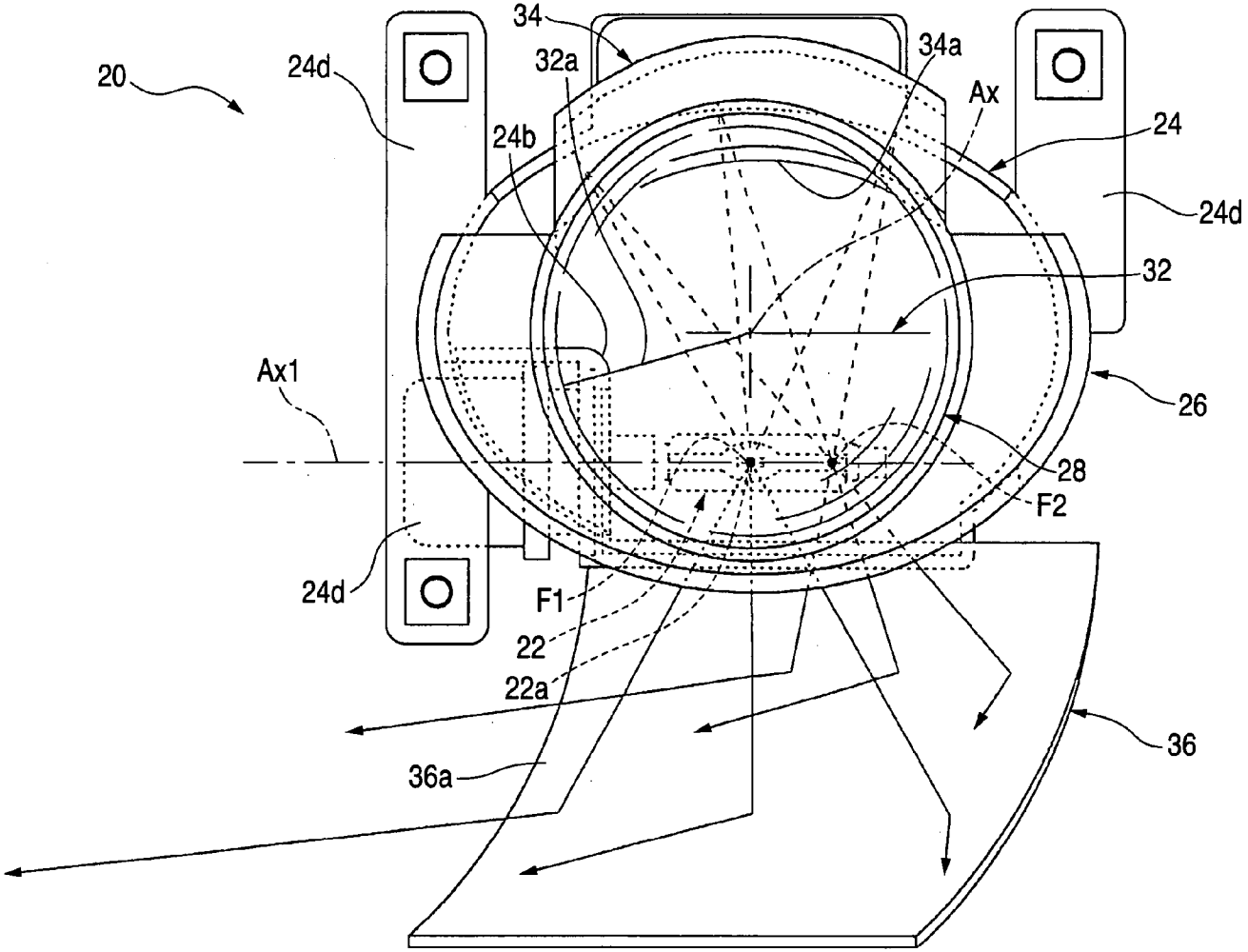
FIG. 6 is a front view showing the lamp unit as a single article and indicating optical paths of light reflected on the first and second additional reflectors, according to the first exemplary, non-limiting embodiment of the present invention.

FIGS. 2 and 3 are side cross-sectional views showing the lamp unit 20 as a single article. FIGS. 4 and 5 are top cross-sectional views showing the lamp unit 20 as a single article. FIG. 6 is a front view showing the lamp unit 20 as a single article.

The lamp unit 20 is a lamp unit of projector type. The lamp unit 20 comprises a light source bulb 22, a reflector 24, a holder 26, a projection lens 28, a shade 32, a first additional reflector 34, and a second additional reflector 36.

The projection lens 28 is configured from a plano-convex lens having a convex surface serving as the front surface and a plane surface serving as the rear surface, and is disposed on the optical axis Ax. The projection lens 28 is configured such that an image on a focal plane including a rear focal point F is projected forward as an reversed image thereof.

The light source bulb 22 is a discharge lamp, such as a metal halide bulb, which employs a discharge light-emitting section as a light source 22*a*. The light source 22*a* is configured as a line segment light source extending parallel to a center axis of the bulb. The light source bulb 22 is fixedly inserted into the reflector 24 from the right of the optical axis Ax at a position to the rear of the rear focal point F of the projection lens 28 and below the optical axis Ax (e.g., a position about 20 mm below the optical axis Ax). The light source bulb 22 is fixedly inserted such that a center of the light source 22*a* is positioned vertically below the optical axis Ax in a state where the bulb center axis Ax1 is set to extend in a horizontal direction within a vertical plane orthogonal to the optical axis Ax.

The reflector 24 has a reflection surface 24*a* for reflecting light from the light source bulb 22 forward and close to the optical axis Ax. The reflection surface 24*a* is configured such that a cross-sectional profile thereof including the optical axis Ax is substantially elliptical. The eccentricity of the ellipse gradually increases from a vertical cross section toward a horizontal cross section. According to the above configuration, as shown in FIGS. 2 and 4, light from the light source 22*a* reflected on the reflection surface 24*a* is substantially converged in the vicinity of the rear focal point F on a vertical cross-sectional plane, and the point of convergence is displaced substantially forward on a horizontal cross-sectional plane.

A bulb insert fixing section 24*b* is formed on a lower right region of the reflection surface 24*a* of the reflector 24 protruding from the reflection surface 24*a*. A bulb insertion hole 24*c* is formed on the left side surface of the bulb insert fixing section 24*b*. The reflector 24 is supported by the lamp body 12 by way of the aiming mechanism 50 on aiming brackets 24*d* disposed at points (e.g., three points) on the reflector 24.

The holder 26 is formed into a substantially cylindrical shape extending forward from a front end opening portion of the reflector 24. The holder 26 is fixedly supported by the reflector 24 at a rear end of the holder 26, and fixes and supports the projection lens 28 at a front end of the same.

The shade 32 is formed integrally with the holder 26 such that the shade 32 is located at a substantially lower half portion in the inner space of the holder 26. The shade 32 is formed such that an upper edge 32*a* thereof passes through the rear focal point F of the projection lens 28. Accordingly, a portion of reflection light reflected from the reflection surface 24*a* is shielded, whereby most of upward light emitted forward from the projection lens 28 is removed.

The first additional reflector 34 is disposed at a position substantially above the optical axis Ax between the light source bulb and the projection lens 28, and is fixed on an upper-front end flange portion 24*e* of the reflector 24.

A reflection surface 34*a* of the first additional reflector 34 is formed into a substantially spheroidal shape whose first focal point F1 is coincident with the center of the light source 22*a*, and whose second focal point F2 is located ahead and to the left of the first focal point F1. By virtue of this configuration, light from the light source 22*a* reflected by the first additional reflector 34 is converged at the second focal point F2. In relation to the above, the second focal point F2 and the first focal point F1 are positioned at the substantially same height. Additionally, an angle θ formed between a focal line FL connecting the focal points F1 and F2 and the bulb center axis Ax1 is set to a value of approximately 30°, and a distance between the focal points F1 and F2 is set to a comparatively small value (e.g., approximately 15 mm).

The second additional reflector 36 is disposed at a position substantially below the optical axis Ax between the reflector 24 and the projection lens 28, and is fixed on a bottom wall 24*f* of the reflector 24.

A reflection surface 36*a* of the second additional reflector 36 is formed into a substantially-parabolic, cylindrically-curved surface whose focal line is a straight line connecting the focal points F1 and F2. In relation to this, a reference axis Ax2 of the second additional reflector 36—which is defined as an axis of a parabola constituting the vertical cross-sectional profile of the parabolic, cylindrically-curved surface—extends in a direction oriented rightward by an angle θ to the optical axis Ax, and is set to be oriented slightly downward (e.g., downward by approximately 3□) from the optical axis Ax. By means of the second additional reflector 36, light from the light source 22*a* is reflected toward the reference axis Ax2 without passing through the projection lens 28.

As shown in FIGS. 3, 5, and 6, direct light from the light source 22*a* enters the second additional reflector 36. Light illuminated from the light source 22*a* and reflected by the first additional reflector 34 enters the second additional reflector 36 as diverging rays from the second focal point F2. However, because the focal points F1 and F2 are positioned on the focal line FL of the second additional reflector 36, all the reflection light from the second reflector 36 is reflected as light that diffuses in a horizontal direction but not in a vertical direction.

Figure 7:
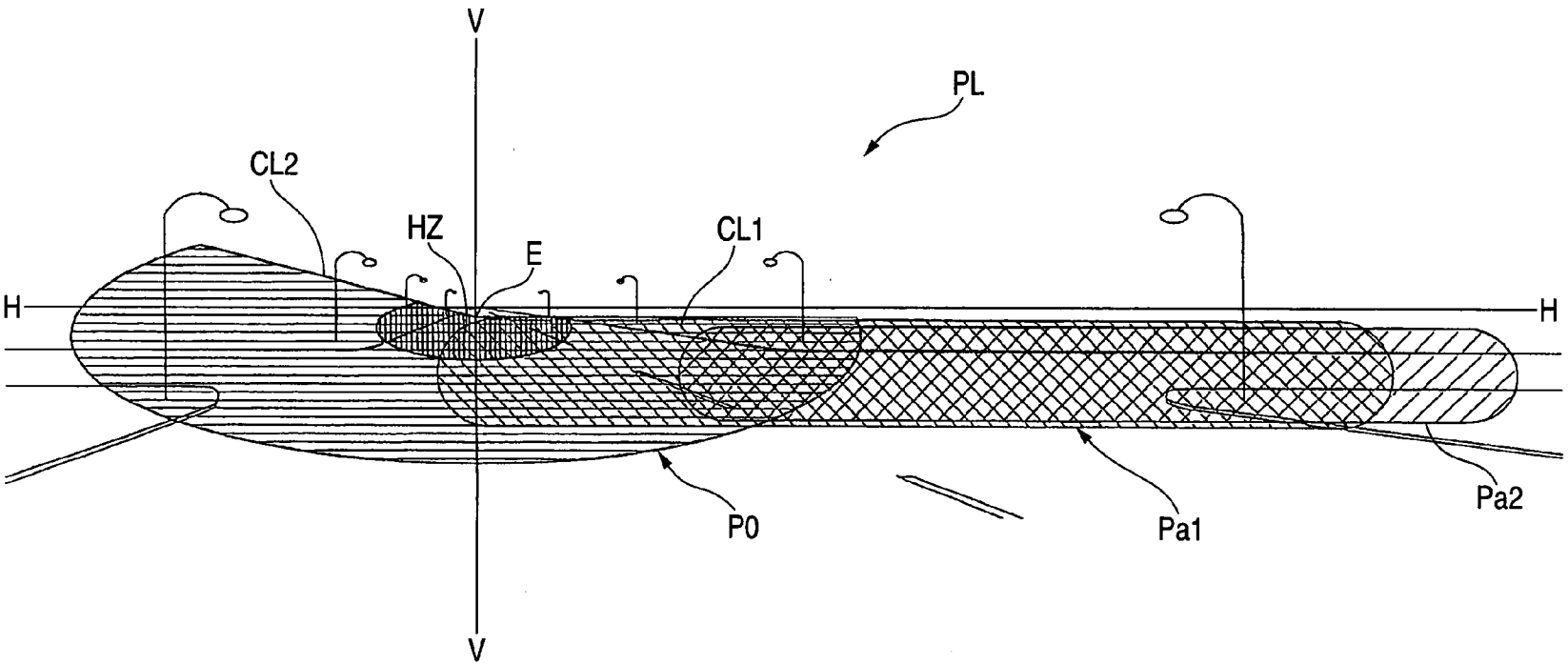
FIG. 7 is a perspective view showing a light distribution pattern formed by light illuminated forward from the vehicle headlamp on a virtual vertical screen placed at a position about 25 m ahead of the lamp, according to the first exemplary, non-limiting embodiment of the present invention.

FIG. 7 is a perspective view showing a light distribution pattern formed by means of light illuminated forward from the vehicle headlamp 10 on a virtual vertical screen placed at a position 25 m ahead of the lamp.

The light distribution pattern is a low-beam light distribution pattern PL of left light distribution, having a horizontal cutoff line CL1 and an oblique cutoff line CL2—which rises at an angle (e.g., approximately 15°) from the horizontal cutoff line CL1 provided at an upper end edge of the low-beam light distribution pattern PL. The position of an elbow point E, which is an intersection point of the cutoff lines CL1 and CL2, is set to a location situated about 0.5 to 0.6° below a point H–V, which is a vanishing point in the direction of the front of the lamp. A hot zone HZ, which is a high-intensity region, is formed into the low-beam light distribution pattern PL to surround the elbow point E.

The low-beam light distribution pattern PL is formed as a composite light distribution pattern of a basic light distribution pattern P0 and two additional light distribution patterns Pa1 and Pa2.

The basic light distribution pattern P0 is a light distribution pattern forming a base shape of the low-beam light distribution pattern PL. The basic light distribution pattern P0 is formed by light illuminated from the light source 22*a*, reflected by the reflector 24, and passed through the projection lens 28. The horizontal and oblique cutoff lines CL1 and CL2 are formed on the basic light distribution pattern P0 as reverse projection images of the upper end edge 32*a* of the shade 32.

The additional light distribution patterns Pa1 and Pa2 are light distribution patterns additionally formed for the purpose of enhancing the right diffusion region of the basic light distribution pattern P0 and spreading the low-beam light distribution pattern PL to the right so as to become wider than the base distribution pattern P0. The additional light distribution patterns Pa1 and Pa2 are formed by reflection light from the second additional reflector 36.

In relation to the above, the additional light distribution pattern Pa1 is a light distribution pattern formed by light illuminated from the light source 22*a* and directly incident to the second additional reflector 36. The additional light distribution pattern Pa2 is a light distribution pattern formed by light illuminated from the light source 22*a* and incident to the second additional reflector 36 by way of the first additional reflector 34. In relation to the above, the light illuminated from the light source 22*a* and directly incident to the second additional reflector 36, and light illuminated from the light source 22*a* by way of the first additional reflector 34, differ in the amount of incidence light and the range of incidence angle. Accordingly, the additional light distribution patterns Pa1 and Pa2 differ in locations where the patterns are formed and in brightness.

More specifically, the additional light distribution pattern Pa1 is formed as a light distribution pattern brighter than the additional light distribution pattern Pa2 and at a location closer to the basic light distribution pattern P0.

The respective upper end edges of the additional light distribution patterns Pa1 and Pa2 are positioned slightly below the horizontal cutoff line CL1. This positioning is due to that the reference axis Ax2 of the second additional reflector 36 being set to be oriented slightly downward from the optical axis Ax.

As described above, the vehicle headlamp 10 according to the first exemplary, non-limiting embodiment is configured as a vehicle headlamp of projector type which illuminates light for forming the low-beam light distribution pattern PL. However, the light source bulb 22 is fixedly inserted into the reflector 24 in a lateral direction to the optical axis Ax extending in the longitudinal direction of the vehicle. Accordingly, the lamp can be reduced in longitudinal length to thus be miniaturized.

In relation to the above, because the light source bulb 22 is fixedly inserted at a position below the optical axis Ax, a region lateral to the optical axis Ax on the reflection surface 24*a* of the reflector 24 can be effectively utilized for light distribution control. Accordingly, by means of forming a diffusion region of the low-beam light distribution pattern PL by use of the reflection light from the region lateral to the optical axis, sufficient brightness can be ensured for the diffusion region.

Furthermore, the vehicle headlamp 10 according to the first exemplary, non-limiting embodiment is configured such that the first and the second additional reflectors 34, 36 allow light from the light source 22*a* to illuminate forward without passing through a projection lens 28. Therefore, the additional light distribution patterns Pa1 and Pa2 formed by such illumination are superposed on the basic light distribution pattern P0 formed by light—which has been reflected on the reflector 24 and passed through the projection lens 28. Accordingly, sufficient brightness can be ensured for the low-beam light distribution pattern PL.

With regard to the above, the first additional reflector 34 has a reflection surface of a substantially-spheroidal shape having its first focal point at the position of the light source 22*a*, and the second additional reflector 36 has a reflection surface of a substantially-parabolic vertical cross-sectional profile having its focal point coincident with the second focal point of the first additional reflector 34. Therefore, the first and second additional reflectors 34, 36 are capable of forming the additional light distribution patterns Pa1 and Pa2 as horizontally elongated light distribution patterns.

Furthermore, because the first additional reflector 34 is disposed at a position above the optical axis Ax, a sufficient distance from the light source 22*a* can be ensured. Because the second additional reflector 36 is disposed at a position below the optical axis Ax, a sufficient distance from the first additional reflector 34 can be ensured. Thus, curvature of the reflection surface 24*a* of the first additional reflector 34 can be reduced to a comparatively small value, whereby control of reflection light by means of the first and second additional reflectors 34, 36 can be conducted with good accuracy.

The projector-type vehicle headlamp according to the first exemplary, non-limiting embodiment is capable of ensuring sufficient brightness of the diffusion region of the low-beam distribution pattern PL even when a lamp configuration is of a lateral insertion type.

Particularly in the first exemplary, non-limiting embodiment, since the reflection surface 36*a* of the second additional reflector 36 is formed into a substantially-parabolic, cylindrically-curved surface, sufficient lateral diffusion angles can be ensured for the respective additional light distribution patterns Pa1 and Pa2.

Since a focal line FL of the substantially-parabolic, cylindrically-curved surface is constituted of a line connecting the first focal point F1 and the second focal point F2 of the first additional reflector 34, not only light reflected by the first additional reflector 34 and incident to the second additional reflector 36, but also light directly incident to the second additional reflector 36 can be reflected as substantially parallel light having little diffusion in a vertical direction, by means of the second additional reflector 36. Accordingly, brightness of the additional light distribution patterns Pa1 and Pa2 can be increased further.

In relation to the above, since the first focal point F1 and the second focal point F2 are positioned at the substantially same height, the additional light distribution patterns Pa1 and Pa2 can be formed as light distribution patterns which accurately extend horizontally.

In the first exemplary, non-limiting embodiment, the shade 32 is disposed in the vicinity of the rear focal point F of the projection lens 28 such that the upper edge 32*a* of the shade 32 is located in the vicinity of the optical axis Ax so as to form the low-beam light distribution pattern PL having the horizontal cutoff line CL1 and the oblique cutoff line CL2 on its upper end edge. According to the above configuration, a portion of reflection light from the reflector 24 is shielded, resulting in loss of some of luminous flux. However, when the configuration of the present embodiment is adopted, the remaining luminous flux can be utilized in an effective manner, whereby sufficient brightness of the low-beam light distribution pattern PL can be ensured.

Furthermore, the first additional reflector 34 is disposed at a position above the optical axis Ax, and the second additional reflector 36 is disposed at a position below the optical axis Ax. Accordingly, reflection light can be easily controlled by means of the first and second additional reflectors 34, 36 without being disturbed by presence of the shade 32.

Formation of the additional light distribution patterns Pa1 and Pa2 enhances the right diffusion region of the basic light distribution pattern P0 and spreads the low-beam light distribution pattern PL right to become wider than the base distribution pattern P0. When a lamp unit 60, in which lateral locations of the first and the second additional reflectors 34, 36 are reversed with respect to the lamp unit 20, as shown in FIG. 8, is adopted, by means of formation of the additional light distribution patterns Pa1 and Pa2 as shown in FIG. 9, the left diffusion region of the basic light distribution pattern P0 can be enhanced and the low-beam light distribution pattern PL can be spread to the left so as to become wider than the base distribution pattern P0.

Figure 9:
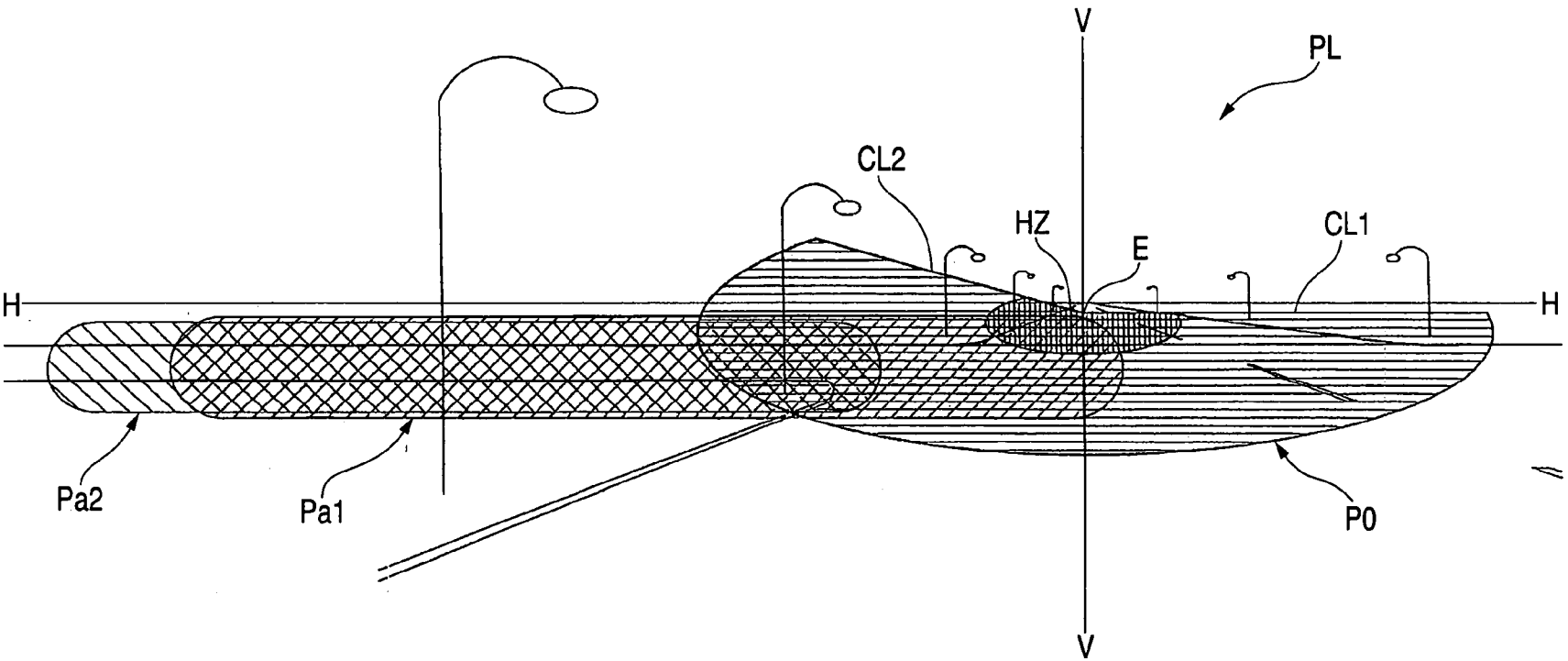
FIG. 9 is a view analogous to FIG. 7, showing effects of the modification.

When a vehicle headlamp including the lamp unit 60 is disposed at a left-front end of the vehicle, the low-beam light distribution pattern PL shown in FIG. 7 and that shown in FIG. 9 can be formed by means of substantially simultaneous illumination of a pair of right and left vehicle headlamps. Accordingly, a laterally wide area on a road ahead of the vehicle can be illuminated by means of a pair of right and left additional light distribution patterns Pa1 and Pa2.

Figure 8:
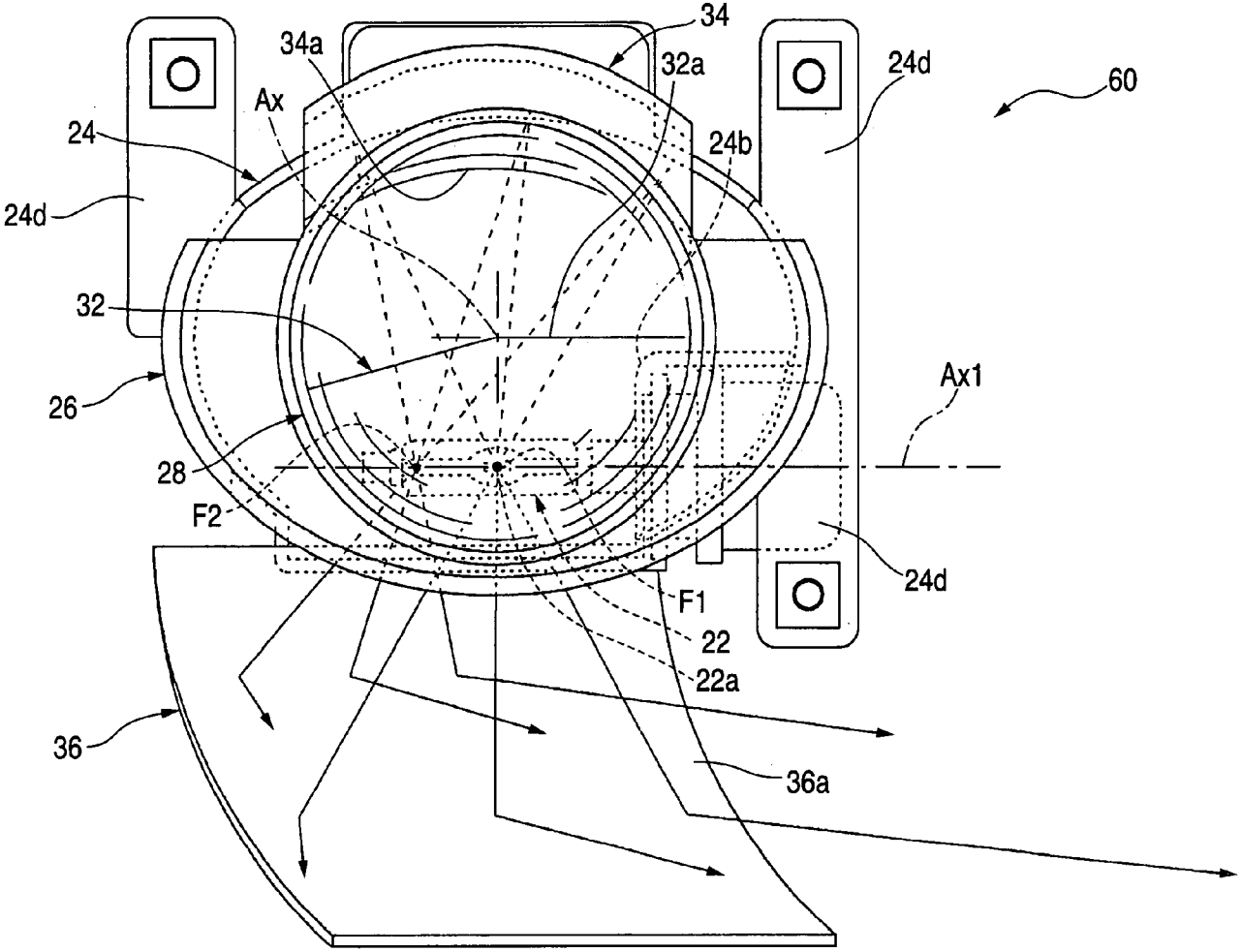
FIG. 8 is a view analogous to FIG. 6, showing a modification of the first exemplary, non-limiting embodiment of the present invention.

To adapt the lamp unit 60 suitable for a vehicle headlamp for the left side, members of the lamp unit 60 other than a portion forming the reflection surface of the reflector 24—which is related to a shape of the basic light distribution pattern P0—and the shade 32 including an insertion direction of the light source bulb 22 and locations of the aiming bracket 24*d* are reversed in lateral position with respect to those of the lamp unit 20 as shown in FIG. 8.

Figure 10:
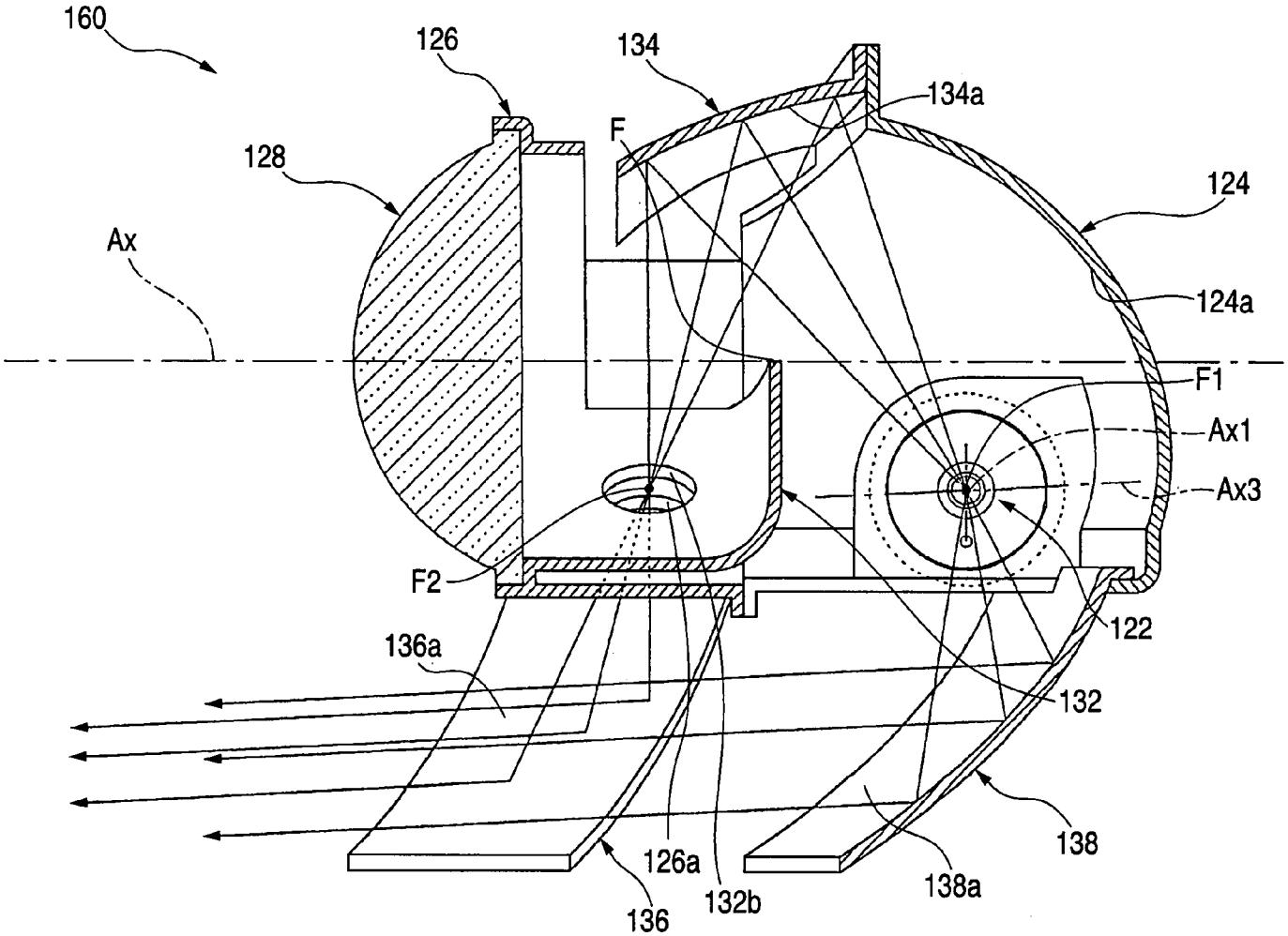
FIG. 10 is a side cross-sectional view showing a lamp unit of a vehicle headlamp according to a second exemplary, non-limiting embodiment of the present invention as a single article.
Figure 11:
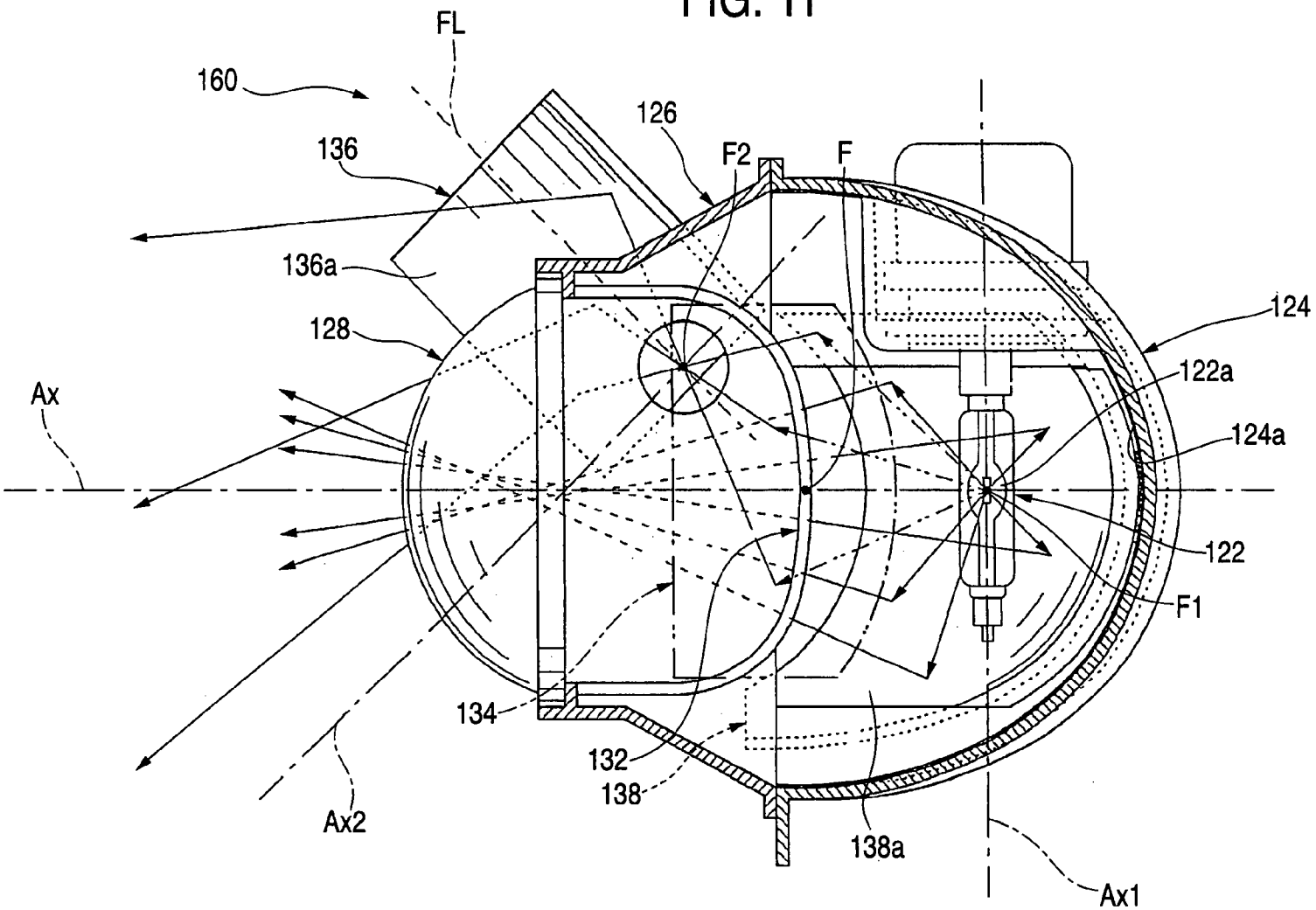
FIG. 11 is a top cross-sectional view showing the lamp unit according to the second exemplary, non-limiting embodiment of the present invention as a single article.

Next, a second exemplary, non-limiting embodiment of the present invention will be described. FIG. 10 is a side cross-sectional view showing a lamp unit 160 of a vehicle headlamp according to a second embodiment as a single article. FIG. 11 is a top cross-sectional view showing the same.

The lamp unit 160 is a lamp unit of a projector type attached to a vehicle headlamp on the left side, and comprises a light source bulb 122, a reflector 124, a holder 126, a projection lens 128, a shade 132, a first additional reflector 134, a second additional reflector 136, and a third additional reflector 138.

Configurations of the light source bulb 122, the reflector 124, the holder 126, the projection lens 128, and the shade 132 are analogous in principle to those of the lamp unit 20 of the first embodiment.

The first additional reflector 134 is disposed at a position substantially above the optical axis Ax and between the light source bulb 122 and the projection lens 128, and is fixed on the reflector 124.

A reflection surface 134*a* of the first additional reflector 134 is formed into a spheroidal shape such that the center of the light source 122*a* is taken as a first focal point F1, and such that a position which is located obliquely ahead of the first focal point F1 as well as ahead the rear focal point F of the projection lens 28 is taken as a second focal point F2. Light from the light source 122*a* reflected on the first additional reflector 134 is converged at the second focal point F2. In relation to the above, the second focal point F2 is positioned at the same height as the first focal point F1. Meanwhile, a region in the vicinity of the second focal point F2 of the shade 132 is configured as an opening section 132*b*, and that of the holder 126 is configured as an opening section 126*a*.

The second additional reflector 136 is disposed at a position below and to the right of the second focal point F2 of the first additional reflector 134, and is fixed on the holder 126.

The reflection surface 136*a* of the second additional reflector 136 is formed into a substantially-parabolic, cylindrically-curved surface whose focal line is the focal line FL passing through the second focal point F2 of the first reflector 134 and extending in a direction oriented rightward by about 45° to the optical axis Ax.

In relation to the above, a reference axis Ax2 of the second additional reflector 136, which is defined as an axis of a parabola constituting the vertical cross-sectional profile of the parabolically-cylindrical curved surface, extends in a direction oriented leftward by approximately 45°. The reference axis Ax2 is set to be oriented slightly downward (e.g., downward by approximately 3°.) from the optical axis Ax. By means of the second additional reflector 136, light from the light 122*a* reflected by the first additional reflector 134 is reflected toward the reference axis Ax2 without passing through the projection lens 128 as light which diffuses in a horizontal direction but not in a vertical direction.

The third additional reflector 138 is disposed at a position below the optical axis Ax between the reflector 124 and the shade 132, and is fixed on the reflector 124. The third additional reflector 138 has a reflection surface 138*a* of a parabolic perpendicular cross-sectional profile whose focal point is at the center of the light source 122*a* (i.e., the same position as the first focal point F1 of the first additional reflector 134).

More specifically, the perpendicular cross-sectional profile of the reflection surface 138*a* is formed from a parabola. A horizontal cross-sectional profile of the same is formed from an ellipse whose major axis is an axis substantially parallel to the optical axis Ax and which passes through the center of the light source 122*a*.

In relation to the above, a reference axis Ax3 of the third additional reflector 138, which is defined as an axis of a parabola and as the major axis of the ellipse, is oriented slightly downward (e.g., downward by approximately 3°) from the optical axis Ax. By means of the third additional reflector 138, light from the light 122*a* is reflected toward the reference axis Ax3 without passing through the projection lens 128, as light which diffuses in a horizontal direction but not in a vertical direction.

A top coating is applied on the reflection surface 138*a* of the third additional reflector 138 by paint that contains a blue dye. Such surface treatment is applied for at least the below reason.

The light source bulb 122 is a discharge bulb, and iodide builds up in a lower region of a discharge chamber thereof. Accordingly, downward light exiting from the light source 122*a* becomes yellowish. Consequently, yellowish light incident to the reflection surface 138*a* of the third additional reflector 138 is disposed below the light source 122*a*. When the top coating is applied on the reflection surface 138*a* with use of paint which contains blue dye—which is a complementary color to yellow—reflection light from the reflection surface 138*a* becomes substantially white light. Thus, the quality of light distribution can be increased.

Figure 12:
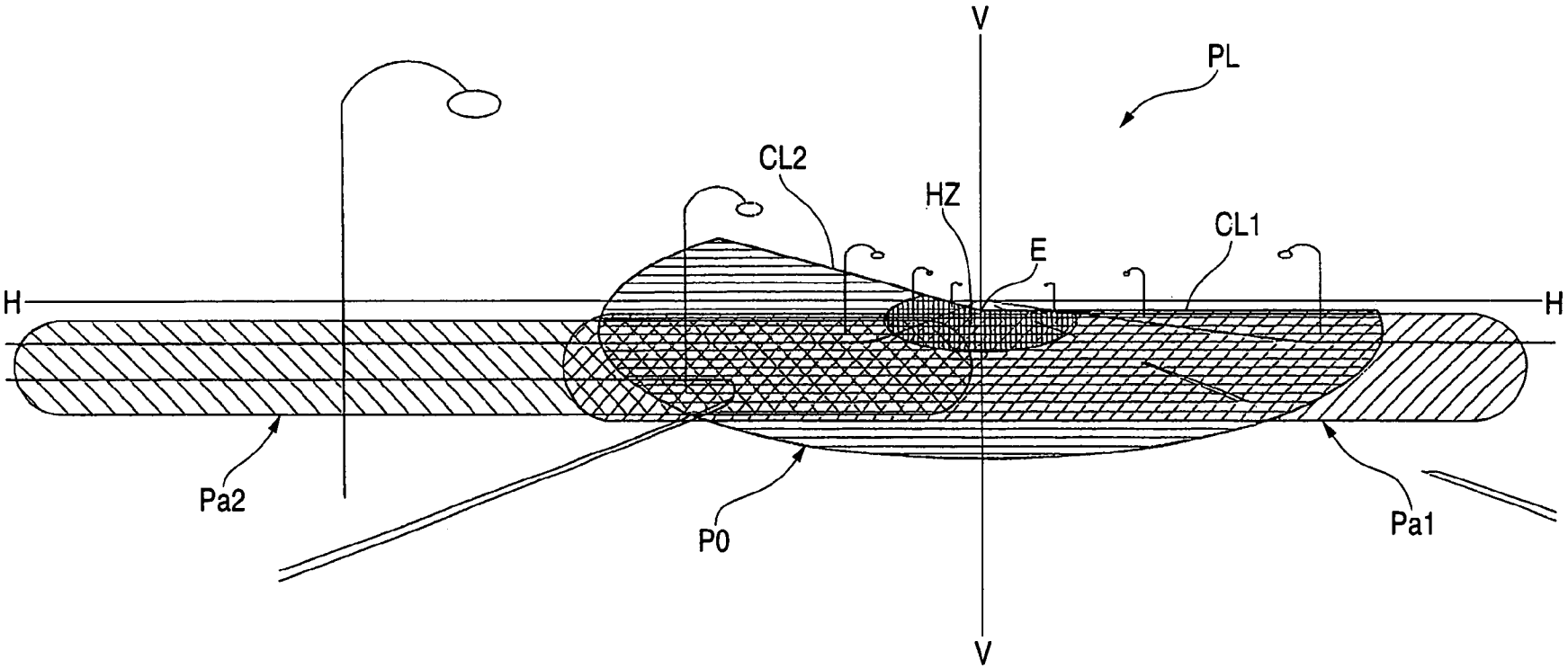
FIG. 12 is a perspective view showing a light distribution pattern formed by light illuminated forward from the vehicle headlamp according to the second exemplary, non-limiting embodiment of the present invention on the virtual vertical screen.

FIG. 12 is a perspective view showing a light distribution pattern formed by means of light illuminated forward from the vehicle headlamp including the lamp unit 160 on the virtual vertical screen. The low-beam light distribution pattern PL is formed as a composite light distribution pattern consisting of the basic light distribution pattern P0 and two additional light distribution patterns of Pa1 and Pa2.

The basic light distribution pattern P0 is completely analogous to the basic light distribution pattern P0 of the above-mentioned embodiment.

Meanwhile, the additional light distribution pattern Pa1 is a light distribution pattern additionally formed to enhance slightly rightward the diffusion region of the basic light distribution pattern P0. The additional light distribution pattern Pa1 is formed from light illuminated from the light source 122*a* and thereafter is directly reflected on the third additional reflector 138.

The additional light distribution pattern Pa2 is a light distribution pattern additionally formed for the purpose of enhancing the left diffusion region of the basic light distribution pattern P0 and spreading the low-beam light distribution pattern PL to the left so as to become wider than the base distribution pattern P0. The additional light distribution pattern Pa2 is formed by light illuminated from the light source 122*a*, and reflected on the second additional reflector 136 after having passed through the first additional reflector 134.

In the second exemplary, non-limiting embodiment, as a result of formation of the additional light distribution patterns Pa1 and Pa2, the right diffusion region of the basic light distribution pattern P0 is enhanced, and the low-beam light distribution pattern PL is spread to the left to become wider than the base distribution pattern P0, as well. When a lamp unit 120, in which locations of the first, second, and third additional reflectors 134, 136, and 138 are laterally reversed with respect to the lamp unit 160, as shown in FIG. 13, is adopted, the diffusion region of the basic light distribution pattern P0 can be enhanced and the low-beam light distribution pattern PL can be spread to the right so as to become wider than the base distribution pattern P0 by means of formation of the additional light distribution patterns Pa1 and Pa2 as shown in FIG. 14.

Figure 14:
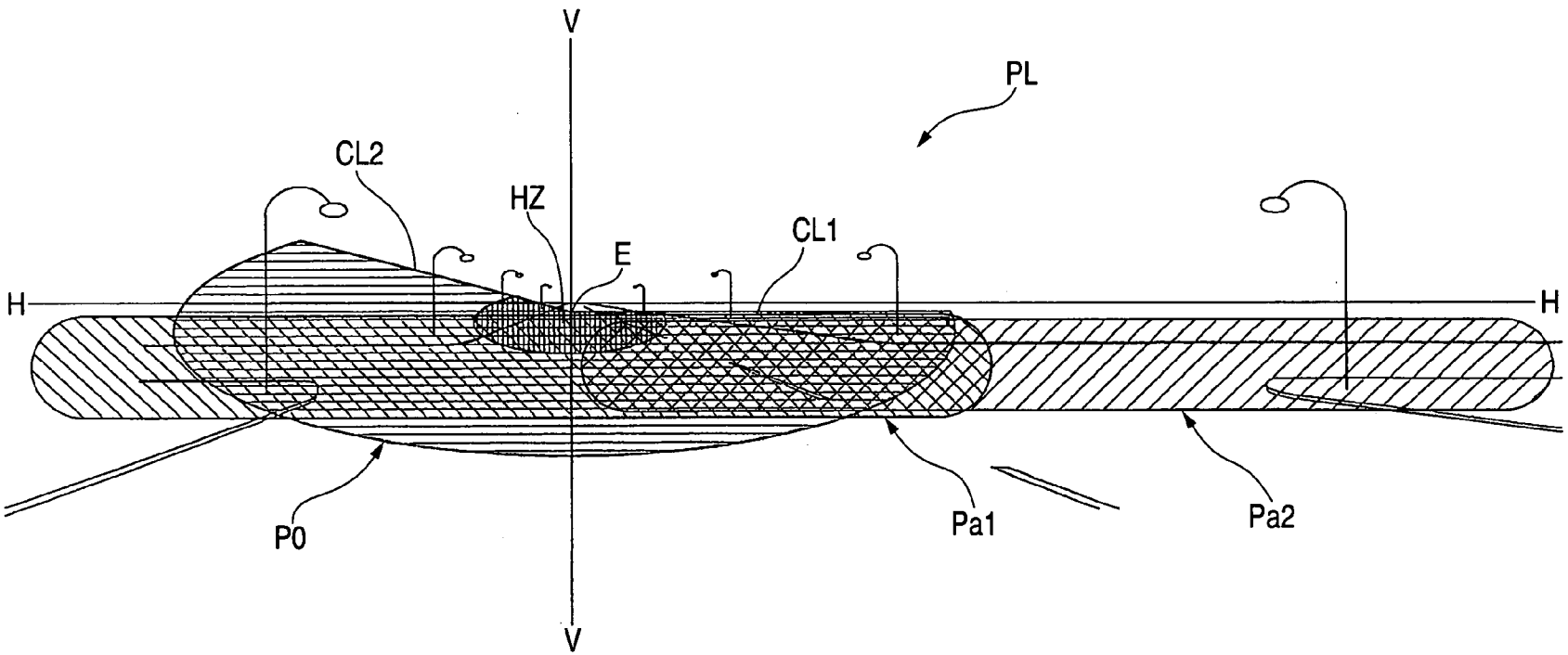
FIG. 14 is a view analogous to FIG. 12, showing effects of the modification of the second exemplary, non-limiting embodiment.

When a vehicle headlamp including the lamp unit 120 is disposed at a right-end of the vehicle, the low-beam light distribution pattern PL shown in FIG. 12 and that shown in FIG. 14 can be formed by means of substantially simultaneous illumination of a pair of right and left vehicle headlamps. Therefore, a laterally wide area on a road ahead of the vehicle can be illuminated by means of a pair of right and left additional light distribution patterns Pa1 and Pa2.

Figure 13:
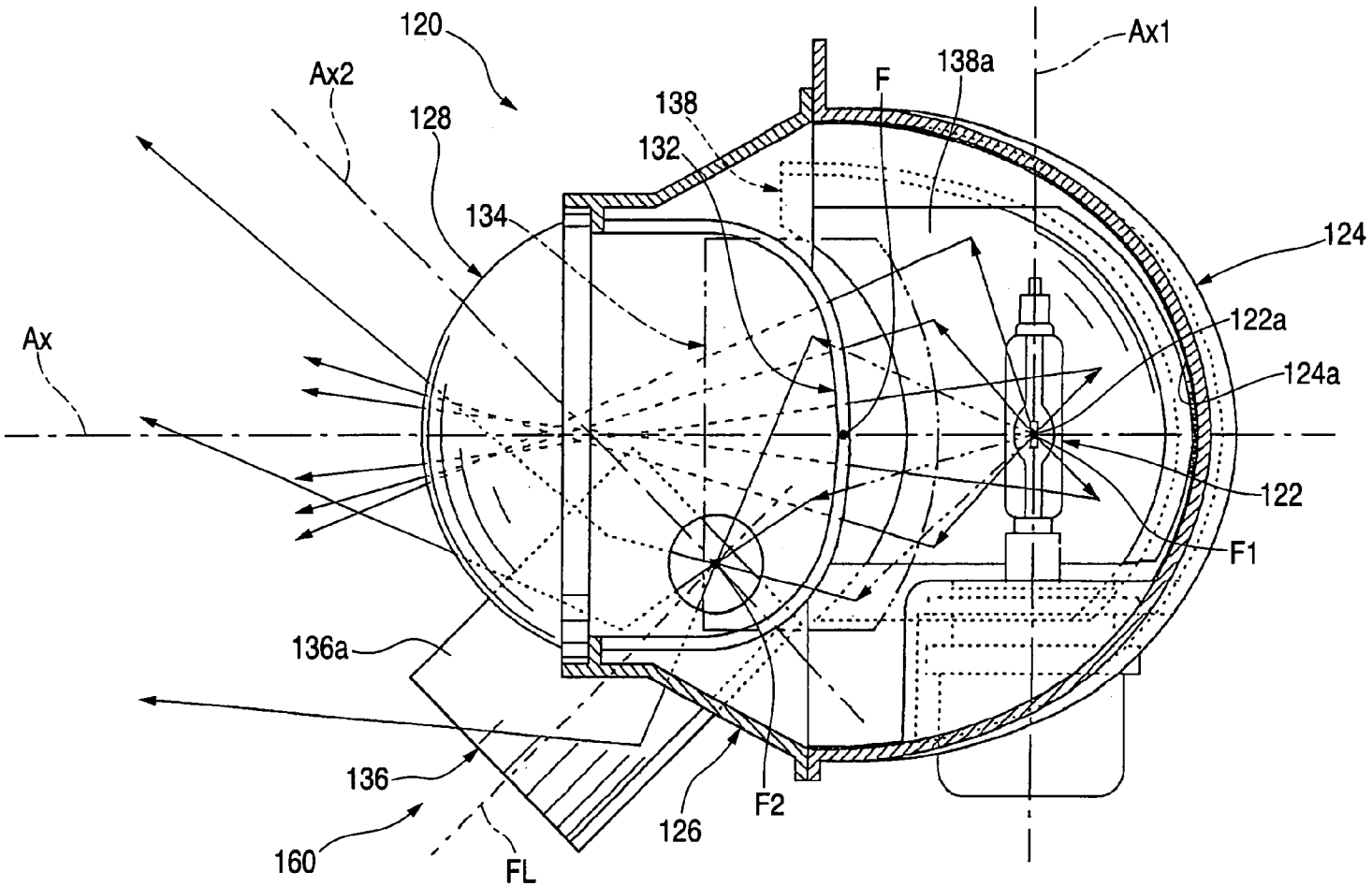
FIG. 13 is a view analogous to FIG. 11, showing a modification of the second exemplary, non-limiting embodiment of the present invention.

For the purpose of adapting the lamp unit 120 suitable for a vehicle headlamp for the right side, members of the lamp unit 120 other than a portion forming the reflection surface of the reflector 124—which is related to a shape of the basic light distribution pattern P0—and the shade 132 are laterally reversed with respect to those of the lamp unit 160 as shown in FIG. 13.

Also in the second exemplary, non-limiting embodiment, the respective upper end edges of the additional light distribution patterns Pa1 and Pa2 are positioned slightly below the horizontal cutoff line CL1. This positioning is due to that the reference axes Ax2, Ax3 of the second and third additional reflectors 136, 138 being set to be oriented slightly downward from the optical axis Ax.

The second embodiment has also been described on an assumption that the first focal point F1 and the second focal point F2 are positioned at the same height. However, in the second embodiment, similar working effects can be obtained even when the second focal point F2 is positioned at a different height from that of the first focal point F1.

Next, a third embodiment of the present invention will be described below.

Figure 15:
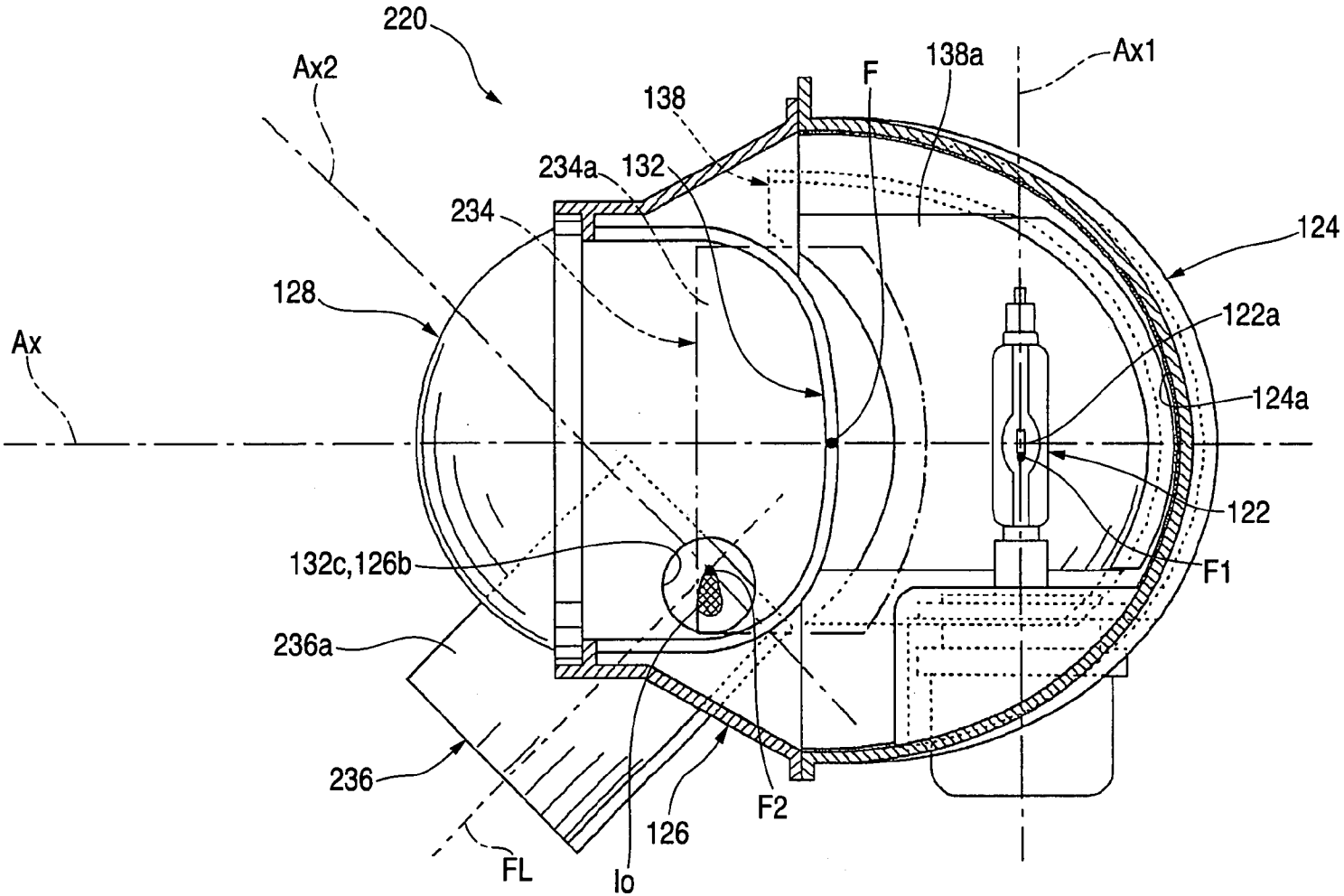
FIG. 15 is a planar cross-sectional view showing a lamp unit of a vehicle headlamp according to a third embodiment of the present invention as a single article.

FIG. 15 is a planar cross-sectional view showing a lamp unit 220 of a vehicle headlamp according to the third embodiment as a single article.

As shown in FIG. 15, the lamp unit 220 is a projector type of lamp unit attached to the right vehicle headlamp. A basic configuration of the lamp unit 220 is the same as that of the lamp unit 120 of the second embodiment, except that configurations of first and second additional reflectors 234 and 236 are different from those of the first and second reflectors 134 and 136 according to the second embodiment.

In other words, the first additional reflector 234 is disposed at a position upwardly spaced from the optical axis Ax between a light source bulb 122 and a projection lens 128 and is fixed to a reflector 124.

A reflection surface 234*a* of the first additional reflector 234 is formed into a spheroidal shape such that the inner end (that is, left end) of the light source 122*a* in a vehicle width direction is taken as a first focal point F1, and such that a position which is located left-obliquely ahead of the first focal point F1 as well as ahead of the rear focal point F of the projection lens 128 is taken as a second focal point F2. Light from the light source 122*a* reflected on the first additional reflector 234 is converged at the second focal point F2. In relation to the above configuration, the second focal point F2 is positioned at the same height as the first focal point F1. Meanwhile, a region in the vicinity of the second focal point F2 of the shade 132 is configured as an opening section 132*b*, and that of the holder 126 is configured as opening portions 132*c* and 126*b*.

The second additional reflector 236 is disposed at a position below and to the left of the second focal point F2 of the first additional reflector 234, and is fixed on the holder 126.

The reflection surface 236*a* of the second additional reflector 236 is formed into a substantially-parabolic, cylindrically-curved surface whose focal line is the straight line FL passing through the second focal point F2 of the first additional reflector 234 and extending in a direction oriented leftward by about 45° to the optical axis Ax.

In relation to the above configuration, a reference axis Ax2 of the second additional reflector 236, which is defined as an axis of a parabola constituting the vertical cross-sectional profile of the parabolically-cylindrical curved surface, extends in a direction oriented rightward by approximately 45° with respect to the optical axis Ax. The reference axis Ax2 is set to be parallel to the optical axis Ax with respect to the vertical direction. By means of the second additional reflector 236, light from the light source 122*a* reflected on the first additional reflector 234 is reflected toward the reference axis Ax2 without passing through the projection lens 128 as light which diffuses in a horizontal direction but not in a vertical direction.

Figure 16A:
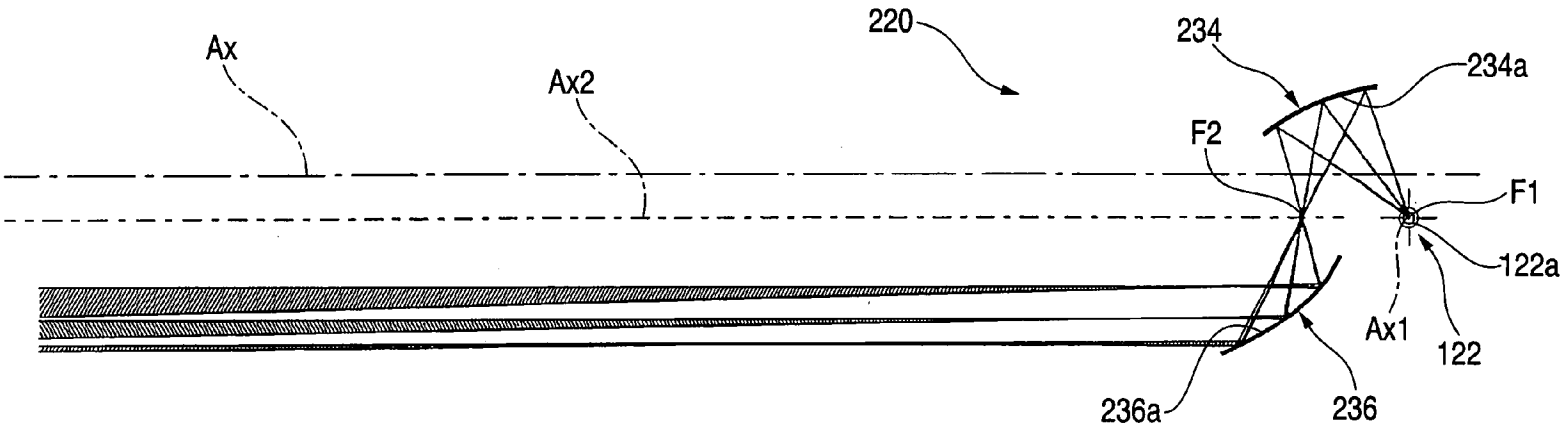
FIG. 16 is a side cross-sectional view of comparing optical paths (FIG. 16(*a*)) of light from a light source irradiated forwardly via a first additional reflector and a second additional reflector in the lamp unit according to the third embodiment of the present invention to the optical paths (FIG. 16(*b*)) in the lamp unit according to the second embodiment.
Figure 16B:
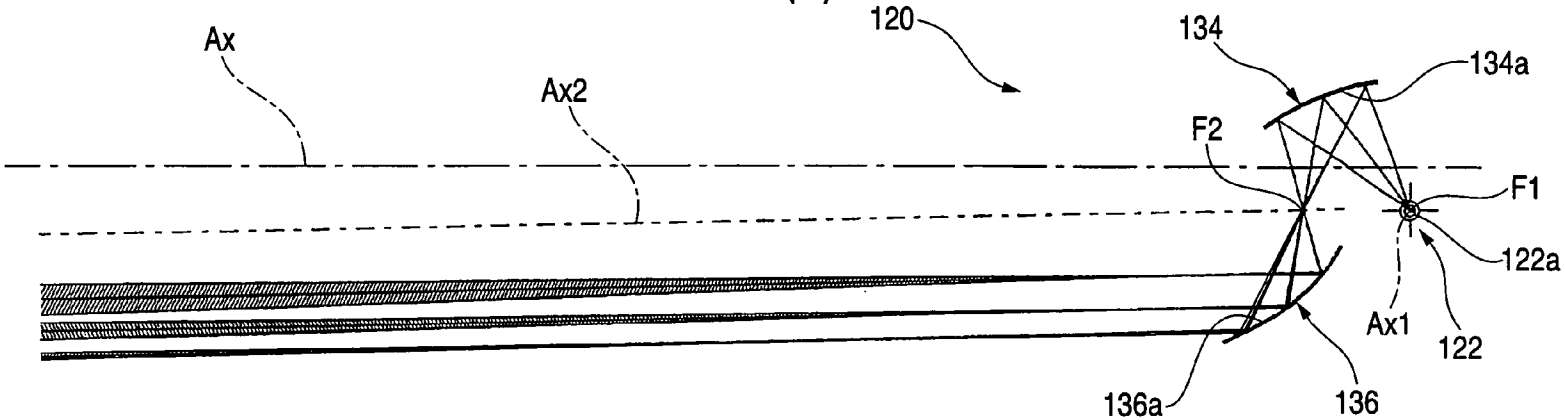

FIG. 16(*a*) is a side cross-sectional view showing optical paths of light from the light source 122*a* irradiated forwardly via the first additional reflector 234 and the second additional reflector 236 in the lamp unit 220 of the third embodiment. In addition, FIG. 16(*b*) is a side cross-sectional view showing optical paths of light from the light source 122*a* irradiated forwardly via the first additional reflector 134 and the second additional reflector 136 in the lamp unit 120 according to the second embodiment.

As shown in FIG. 16(*b*), in the lamp unit 120 according to the second embodiment, the light reflected from the second additional reflector 136 is parallel to the reference axis Ax2 positioned slightly below with respect to the optical axis Ax. At this time, since the first focal point F1 of the first additional reflector 134 is positioned at the center of the light source 122*a*, an image of the light source formed on a focal plane including the second focal point F2 becomes an image whose center is positioned at the second focal point F2. Therefore, the light reflected from the respective positions of the reflection surface 136*a* of the second additional reflector 136 is diffused so as to be equal to each other at both sides of the optical line indicated by an arrow in the drawing in the vertical direction. A similar light source image formed by the reflected light becomes gradually smaller and brighter according to the variation of the reflection position from the upper end circumference of the reflected surface 136*a* to the lower end circumference.

On the other hand, as shown in FIG. 16(*a*), in the lamp unit 220 according to the third embodiment, the light reflected from the second additional reflector 236 becomes light parallel to the reference axis Ax2 positioned parallel to the optical axis Ax with respect to the vertical direction. At this time, since the first focal point F1 of the first additional reflector 234 is positioned at the left end of the light source 122*a*, the light source image Io formed on a focal plane including the second focal point F2 becomes an image whose right end is positioned at the second focal point F2. In addition, since the reference axis Ax2 of the second additional reflector 236 extends in a direction slanted toward the right side from the optical axis Ax, the light reflected from the respective positions of the reflection surface 236*a* of the second additional reflector 236 is diffused toward the lower side of the light ray indicated by an arrow in the drawing in the vertical direction. The similar light source image formed by the reflected light becomes gradually smaller and brighter according to the variation of the reflection position from the upper end circumference of the reflected surface 236*a* to the lower end circumference of the reflected surface 236*a*.

Figure 17A:
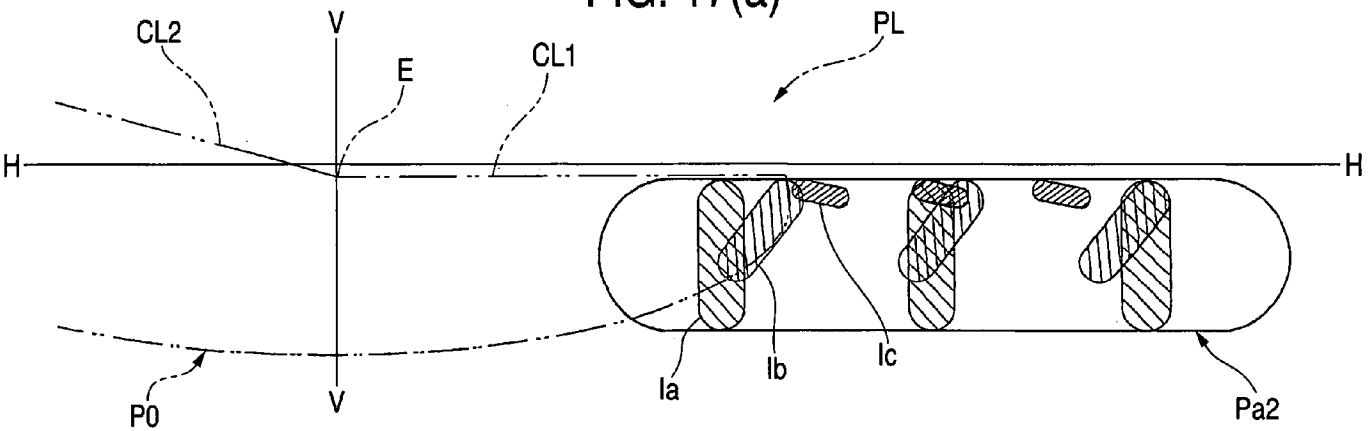
FIG. 17 is a side cross-sectional view of comparing light distribution patterns (FIG. 17(*a*)) formed on the virtual vertical screen by the light from a light source irradiated forwardly via the first additional reflector and the second additional reflector in the lamp unit according to the third embodiment of the present invention to the light distribution patterns (FIG. 17(*b*)) in the lamp unit according to the second embodiment.
Figure 17B:
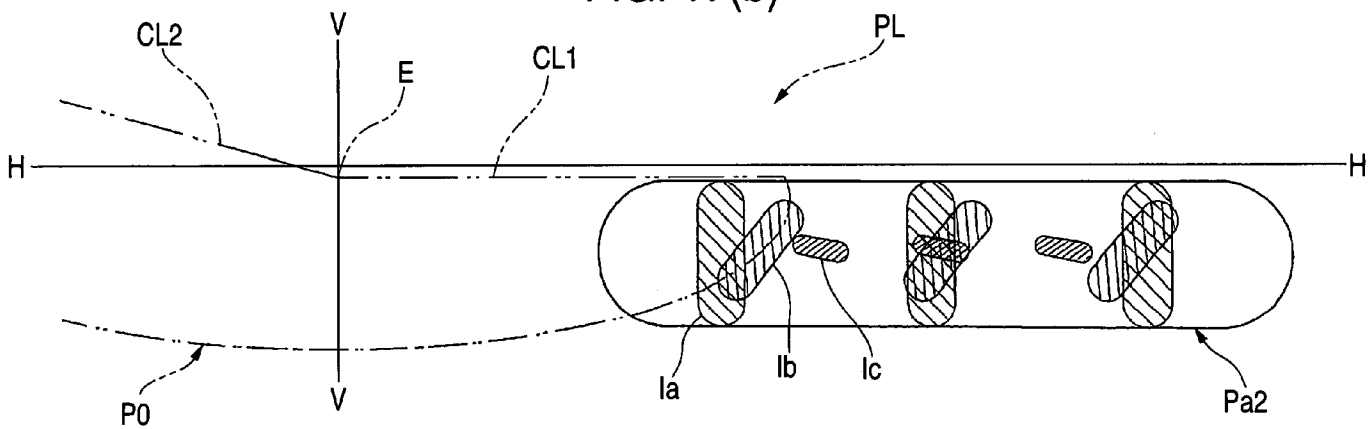

FIG. 17(*a*) is a view showing a light distribution pattern Pa2 formed on the virtual vertical screen by the light from the light source 122*a* irradiated forwardly via the first additional reflector 234 and the second additional reflector 236 in the lamp unit 220 according to the third embodiment. In addition, FIG. 17(*b*) is a view showing a light distribution pattern Pa2 formed on the virtual vertical screen by the light from the light source 122*a* irradiated forwardly via the first additional reflector 134 and the second additional reflector 136 in the lamp unit 120 according to the second embodiment.

In addition, FIGS. 17(*a*) and 17(*b*) show a state which makes the diffusion angle of the light distribution pattern Pa2 in the horizontal direction smaller than the actual diffusion angle, for convenience.

As shown in FIG. 17(*b*), the light distribution pattern Pa2 formed by the light reflected from the second additional reflector 136 of the lamp unit 120 according to the second embodiment is constituted as a collection of a plurality of similar light source images formed by the reflected light from the respective positions of the reflection surface 136*a* of the second additional reflector 136. At this time, as described above, the similar light source image Ic formed by the light reflected from the lower end circumference of the reflection surface 136*a* is smaller and brighter than the similar light source image Ia formed by the light reflected from the upper end circumference of the reflection surface 136*a*. The similar light source image Ib formed by the light reflected from the central portion of the reflection surface 136*a* becomes an intermediate image those of. In addition, the similar light source images Ia, Ib and Ic are positioned at the sides lower than the horizontal cutoff line CL1 by the extent of the reference axis Ax2 of the second additional reflector 136 being positioned below with respect to the optical axis Ax.

On the other hand, as shown in FIG. 17(*a*), the light distribution pattern Pa2 formed by the light reflected from the second additional reflector 236 of the lamp unit 220 according to the third embodiment is also constituted as a collection of a plurality of similar light source images formed by the reflected light from the respective positions of the reflection surface 236*a* of the second additional reflector 236. In addition, the similar light source image Ic formed by the light reflected from the lower end circumference of the reflection surface 236*a* is smaller and brighter than the similar light source image Ia formed by the light reflected from the upper end circumference of the reflection surface 236*a*. The similar light source image Ib formed by the light reflected from the central portion of the reflection surface 236*a* becomes an intermediate image those of. However, since the reference axis Ax2 of the second additional reflector 236 extends parallel to the optical axis Ax in the vertical direction and the light reflected from the respective positions of the reflectance surface 236*a* of the second additional reflector 236 becomes the light diffusing toward the lower side of the light ray indicated by the arrow in FIG. 16(*a*), the upper end circumferences of the similar light source images Ia, Ib and Ic are lined up at the positions of the horizontal cutoff line CL1.

By adopting the configuration of the third embodiment, it is possible to improve the long distance visibility of the road surface ahead of the vehicle outside the vehicle width direction and to irradiate the light onto the road surface ahead of the vehicle uniformly.

Next, a fourth embodiment of the present invention will be described.

Figure 18:
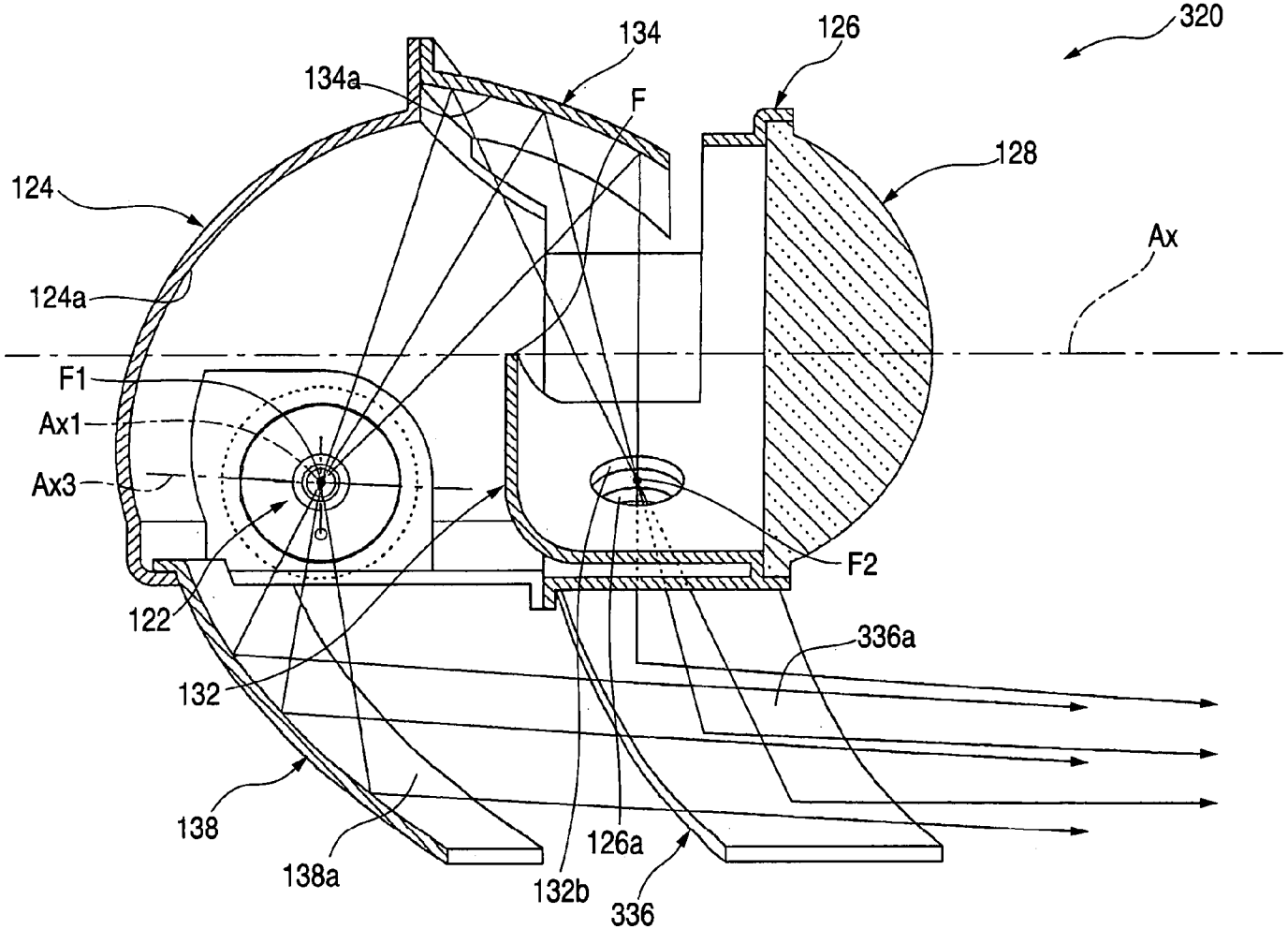
FIG. 18 is a side cross-sectional view showing a lamp unit of a vehicle headlamp according to a fourth embodiment of the present invention as a single article.

FIG. 18 is a side cross-sectional view showing a lamp unit 320 of a vehicle head lamp according to the fourth embodiment of the present invention as a single article.

As shown in FIG. 18, the lamp unit 320 is a projector type of lamp unit attached to the right vehicle headlamp. A basic configuration of the lamp unit 320 is the same as that of the lamp unit 120 of the second embodiment, except that a configuration of a second additional reflector 336 is different from that of the second additional reflectors 136 of the second embodiment.

In other words, the second additional reflector 336 is set to be oriented downward from the left side of a second focal point F2 of a first additional reflector 134 and is fixed on a holder 126.

Figure 19A:
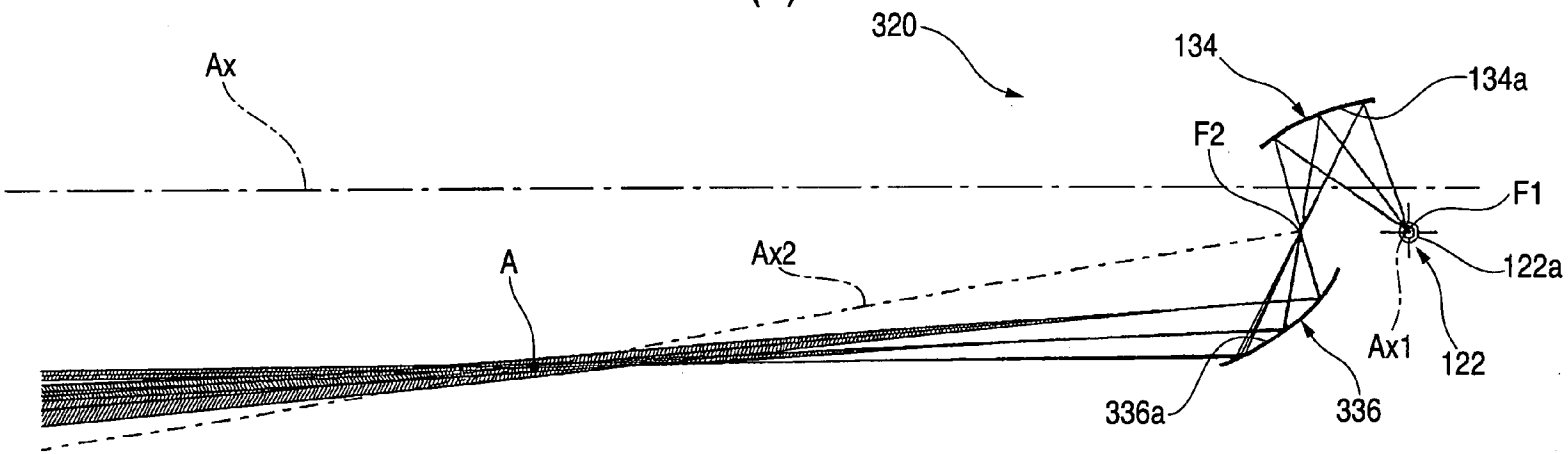
FIG. 19 is a side cross-sectional view of comparing optical paths (FIG. 19(*a*)) of light from a light source irradiated forwardly via a first additional reflector and a second additional reflector in a lamp unit according to a fourth embodiment of the present invention to the optical paths (FIG. 19(*b*)) in the lamp unit according to the second embodiment.
Figure 19B:
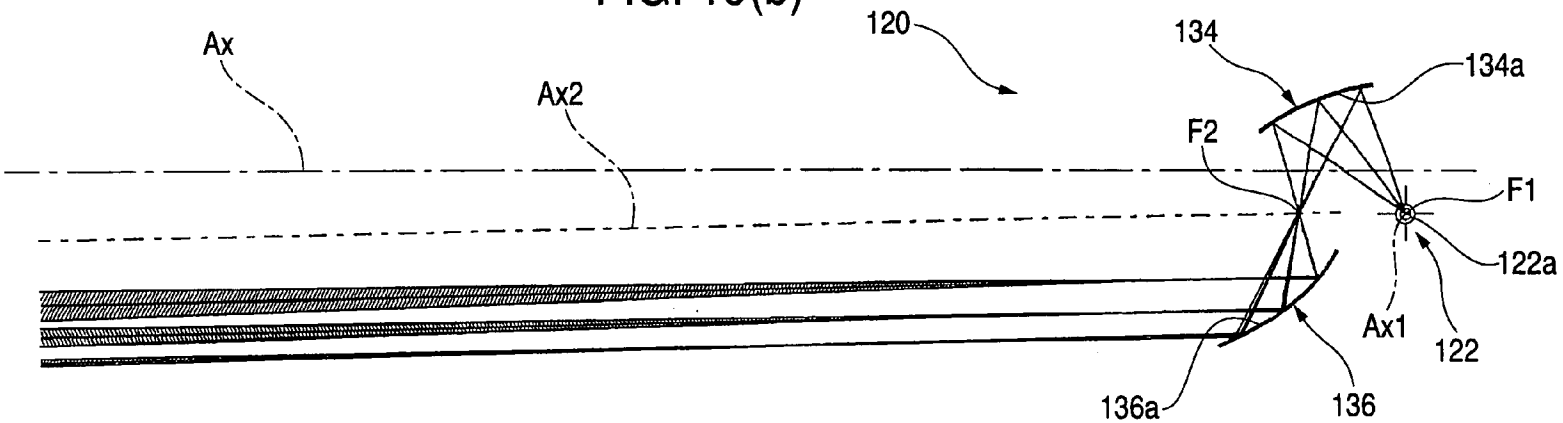

The reflection surface 336*a* of the second additional reflector 336 has as a first focal point the second focal point F2 of the first additional reflector 134 and has an elliptical-shaped vertical cross-sectional shape, having as a second focal point a point A (refer to FIG. 19(*a*)) positioned at a position having the same height as the lower end circumference of the reflection surface 336*a* ahead of a predetermined distance with respect to the first focal point, and its major axis extends in a direction oriented rightward by approximately 45° with respect to the optical axis Ax. In addition, the reflection surface 336*a* is formed into a parabolic, cylindrically curved surface, having as a focal line a straight line extending in a direction oriented leftward by approximately 45° with respect to the optical axis Ax.

In addition, the second additional reflector 336 reflects the light such that the light from the light source 122*a* reflected on the first additional reflector 134 is not diffused substantially in the vertical direction and is diffused in a horizontal direction toward the direction of the reference axis Ax2 (refer to FIG. 19(*a*)) without passing through the projection lens 128.

FIG. 19(*a*) is a side cross-sectional view showing optical paths of light from the light source 122*a* irradiated forwardly via the first additional reflector 134 and the second additional reflector 336 in the lamp unit 320 according to the fourth embodiment. The description of FIG. 19(*b*) is the same as that of FIG. 16(*b*).

As shown in FIG. 19(*a*), in the lamp unit 320 according the fourth embodiment, the light reflected from the first additional reflector 134 to be incident on a region close to the lower end circumference in the reflection surface 336*a* of the second additional reflector 336 is reflected in a direction substantially parallel to the optical axis Ax with respect to the vertical direction and is reflected downward as the light approaches the lower end circumference. At this time, a similar light source image formed by the light reflected from the second additional reflector 336 becomes gradually smaller and brighter according to the variation of the reflection position of the reflected surface 336*a* from the upper end circumference to the lower end circumference.

Figure 20A:
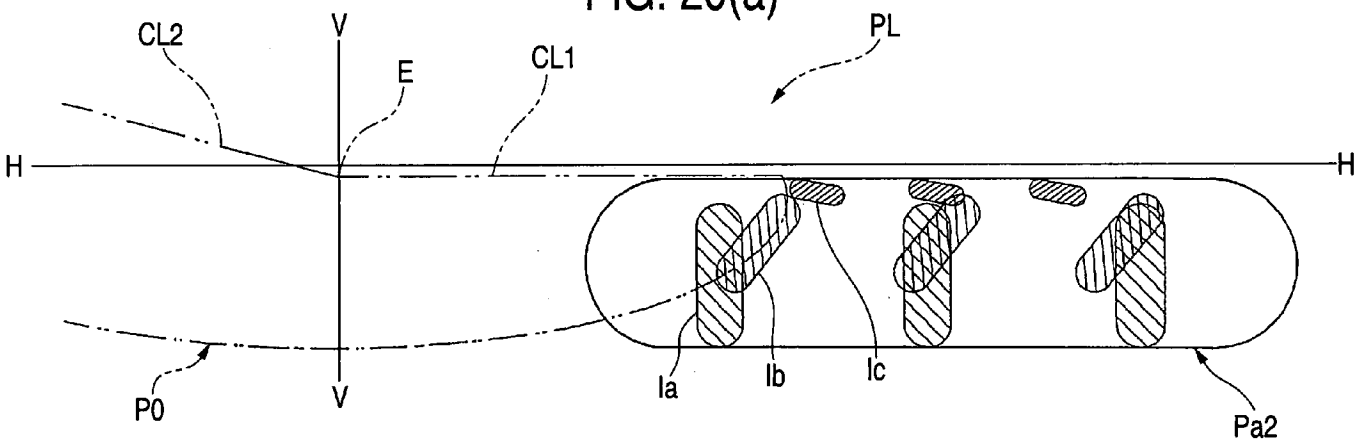
FIG. 20 is a side cross-sectional view of comparing light distribution patterns (FIG. 20(*a*)) formed on the virtual vertical screen by the light from a light source irradiated forwardly via the first additional reflector and the second additional reflector in the lamp unit according to the fourth embodiment of the present invention to the light distribution patterns (FIG. 20(*b*)) in the lamp unit according to the second embodiment.
Figure 20B:
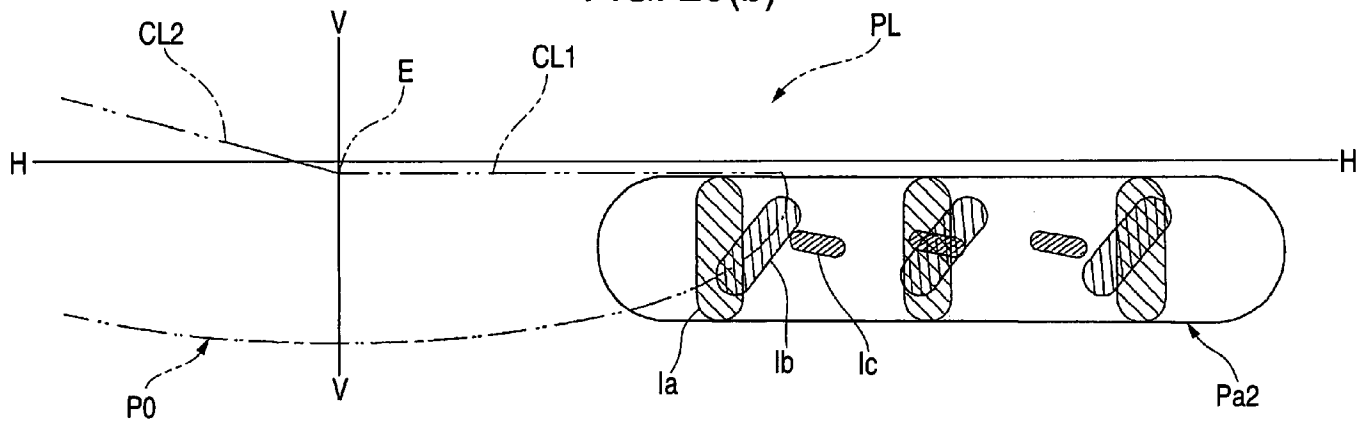

FIG. 20(*a*) is a view showing a light distribution pattern Pa2 formed on the virtual vertical screen by the light from the light source 122*a* irradiated forwardly via the first additional reflector 134 and the second additional reflector 336 in the lamp unit 320 according the fourth embodiment. In addition, the description of FIG. 20(*b*) is the same as that of FIG. 17(*b*).

In addition, FIGS. 20(*a*) and 20(*b*) show a state which makes the diffusion angle of the light distribution pattern Pa2 in the horizontal direction smaller than the actual diffusion angle, for convenience.

As shown in FIG. 20(*a*), the light distribution pattern Pa2 formed by the light reflected from the second additional reflector 336 of the lamp unit 320 according to the fourth embodiment is constituted as a collection of a plurality of similar light source images formed by the reflected light from the respective positions of the reflection surface 336*a* of the second additional reflector 336. In addition, the similar light source image Ic formed by the light reflected from the lower end circumference of the reflection surface 336*a* is smaller and brighter than the similar light source image Ia formed by the light reflected from the upper end circumference of the reflection surface 336*a*. The similar light source image Ib formed by the light reflected from the central portion of the reflection surface 336*a* becomes an intermediate image those of. At this time, since the light reflected from the lower end circumference of the reflection surface 336*a* of the second additional reflector 336 is reflected in a direction parallel to the optical axis Ax with respect to the vertical direction, the upper end circumference of the similar light source image Ic formed by the reflected light is positioned at the region close to the horizontal cutoff line CL1. In addition, since the reflected light is reflected downward as the reflection position approaches the upper end circumference, the similar light source image Ia is formed at the position lower than the horizontal cutoff line CL1. In addition, the similar light source image Ib is positioned as the central position.

By employing the configuration of the fourth embodiment, the small and bright similar light source Ic of the plurality of similar light source images Ia, Ib, and Ic having different sizes and brightnesses is positioned at the upper end circumference so that the light distribution pattern Pa2 can be formed. As a result, it is possible to improve the long distance visibility of the road surface ahead of the vehicle outside the vehicle width direction. In addition, it is possible to form the vertical width of the light distribution pattern Pa2 so as to be larger than the light distribution pattern Pa2 formed according to the third embodiment shown in FIG. 17(*a*). Therefore, it is possible to irradiate the light onto the road surface ahead of the vehicle uniformly from a short distance region to a long distance region.

Also, the first embodiment has been described on an assumption that the reference axis Ax2 of the second additional reflector 36 extends in a direction tilted by about 30° from the optical axis Ax. However, as is apparent, the tilt angle can be set to another value. By changing the tilt angle, positions where the additional light distribution patterns Pa1 and Pa2 are formed can be offset in a lateral direction.

Furthermore, the second embodiment has been described on an assumption that the reference axis Ax2 of the second additional reflector 136 extends in a direction tilted by about 45° from the optical axis Ax, and the reference axis Ax3 of the third additional reflector 138 extends in a direction parallel to the optical axis Ax. However, as is apparent to one of ordinary skill in the art, tilt angles of the second and third additional reflectors 136, 138 can be set to other values. By changing the tilt angles, positions where the additional light distribution patterns Pa1 and Pa2 are formed can be offset in a lateral direction.

The first embodiment has been described on the assumption that the reflection surface 36*a* of the second additional reflector 36 is formed to have a parabolic perpendicular cross-sectional profile, and the second embodiment has been described on an assumption that the reflection surfaces 136*a*, 138*a* of the second and third additional reflectors 136, 138 are formed so as to have a parabolic perpendicular cross-sectional profile. However, instead of adopting such a configuration, a curve, in which a parabola for illuminating reflected light farther and a parabolic curve deformed to a certain amount so as to illuminate reflection light slightly downward are connected, can be employed as a perpendicular cross-sectional profile. When such a configuration is adopted, the additional light distribution patterns Pa1 and Pa2 can be formed as light distribution patterns which are capable of illuminating a road ahead of the vehicle over a wide area including a region close to a driver.

The respective embodiments have been described on an assumption that the light source bulb 22, 122 is inserted from the lateral direction to the reflector 24, 124. However, when an insertion angle is offset from the lateral direction, working effects substantially analogous to those of the embodiments can be obtained so long as the deviation falls within a range of approximately 30° in a vertical direction or a longitudinal direction.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

The invention claimed is:

1. A vehicle headlamp having a projection lens disposed on an optical axis extending in a longitudinal direction of a vehicle, a light source disposed to the rear of a rear focal point of the projection lens, and a reflector for reflecting light from the light source forward and substantially close to the optical axis, said light source comprising:

a light-emitting section of a light source bulb fixedly inserted into said reflector in a lateral direction to said optical axis at a position below said optical axis;

a first additional reflector with a substantially- spheroidal reflection surface having a first focal point at the position of said light source, and which is disposed at a position upwardly spaced from said optical axis; and a second additional reflector disposed at a position downwardly spaced from the optical axis, the second additional reflector forwardly diffusing-reflecting light from the light source reflected on the first additional reflector in the horizontal direction without passing through the projection lens.

2. The vehicle headlamp according to claim 1, wherein a reflection surface of the second additional reflector is formed into a substantially-parabolic vertical cross-sectional shape, having as a focal point a second focal point of the first additional reflector.

3. The vehicle headlamp according to claim 2, wherein said reflection surface of said second additional reflector is a substantially-parabolic, cylindrically-curved surface.

4. The vehicle headlamp according to claim 3, wherein a focal line of said reflection surface is a straight line connecting said first focal point to said second focal point.

5. The vehicle headlamp according to claim 4, wherein said first focal point and said second focal point positioned at the substantially same level.

6. The vehicle headlamp according to claim 1, wherein said light-emitting section is composed of a line segment light source extending along the central axis of the light source bulb, said first focal point of the first additional reflector is positioned at a point close to the inner end of the line segment light source in the vehicle width direction, and said second additional reflector is disposed toward the outside of the vehicle width direction with respect to a front direction of the optical axis direction.

7. The vehicle headlamp according to claim 1, wherein said reflection surface of the second additional reflector has as a first focal point the second focal point of the first additional reflector, and is formed into a substantially elliptical vertical cross-sectional shape, and has as a second focal point a point positioned at a substantially same height as the lower end circumference of the reflection surface ahead of a predetermined distance with respect to the first focal point.

8. The vehicle headlamp according to claim 1, wherein said second additional reflector is offset to one of right and left in relation to said optical axis at a position substantially between said light source and said projection lens, and is closer to said projection lens than to said light source, and further comprising:

a third additional reflector that reflects light from said light source forward is disposed at a position below said light source; and a reflection surface of said third additional reflector that reflects light from said light source as light substantially collimated in relation to a vertical direction, and closer to said optical axis with respect to a horizontal direction.

9. The vehicle headlamp according to claim 2, wherein a shade that shields a portion of the light reflected from said reflector is disposed in a vicinity of said rear focal point such that an upper end edge of said shade is positioned in a vicinity of said optical axis.

10. The vehicle headlamp according to claim 1, wherein a shade that shields a portion of the light reflected from said reflector is disposed in a vicinity of said rear focal point such that an upper end edge of said shade is positioned in a vicinity of said optical axis.

11. A vehicle headlamp having a lamp body with a chamber and a cover, comprising:

a lamp unit with an optical axis and including a light source positioned below said optical axis, and a plurality of reflectors that reflect light generated by said light source, said plurality of reflectors comprising, a first reflector that reflects light from said light source forward and substantially close to said optical axis, wherein said first reflector is elliptical, a second reflector positioned substantially above said optical axis and between the light source and a projection lens, said second reflector reflecting light generated by said light source to one of a first focal point and a second focal point positioned at a substantially same height, and a third reflector positioned substantially below said optical axis and between the light source and the projection lens, wherein said third reflector reflects light generated by said light source to form a first output pattern, and reflects light reflected by said second reflector to form a second output pattern.

12. The vehicle headlamp of claim 11, wherein said third reflector has a focal line that connects said first focal point and said second focal point.

13. The vehicle headlamp of claim 11, wherein said first elliptical reflector has an eccentricity that increases from a vertical to a horizontal cross section thereof.

14. The vehicle headlamp of claim 11, wherein said second reflector is attached at an upper portion of said first reflector, and said third reflector is attached at a lower portion of said first reflector.

15. The vehicle headlamp of claim 11, wherein the second focal point is at a position obliquely ahead of the first focal point and a rear focal point of the projection lens.

16. The vehicle headlamp of claim 11, wherein the second reflector has a substantially spheroidal reflection surface and the third reflector has a substantially parabolic, cylindrically curved surface.

17. The vehicle headlamp of claim 11, further comprising a fourth reflector positioned below the optical axis and between the reflector and a shade positioned between said light source and said cover that substantially blocks a portion of light generated by said light source, and having a reflection surface with a parabolic perpendicular cross-sectional profile having its focal point substantially at said light source.

18. The vehicle headlamp of claim 17, wherein the fourth reflector has a colored dye on its reflecting surface so as to generate substantially white light.

19. The vehicle headlamp of claim 18, wherein said colored dye is blue.

20. The vehicle headlamp of claim 19, wherein a perpendicular cross-section profile is a parabola shape and horizontal cross-section profile is an ellipse shape with a major axis substantially parallel to the optical axis and passing through a center of the light source.

* * * * *